US006406354B1

(12) United States Patent
Yamauchi et al.

(10) Patent No.: US 6,406,354 B1
(45) Date of Patent: Jun. 18, 2002

(54) TAPE-LIKE CONNECTING DEVICE AND WOMEN'S CLOTHING WITH CUPS

(75) Inventors: Hiromi Yamauchi; Shuji Sakaki, both of Kyoto (JP)

(73) Assignee: Wacoal Corporation (JP)

( * ) Notice: Subject to any disclaimer, the term of this patent is extended or adjusted under 35 U.S.C. 154(b) by 0 days.

(21) Appl. No.: 09/698,555

(22) Filed: Oct. 27, 2000

Related U.S. Application Data

(63) Continuation-in-part of application No. PCT/JP99/02066, filed on Apr. 19, 1999.

(30) Foreign Application Priority Data

Apr. 27, 1998 (JP) ..... 10-117456
Dec. 22, 1998 (JP) ..... 10-364794
Dec. 28, 1998 (JP) ..... 10-039168

(51) Int. Cl.[7] ..... A41C 3/02
(52) U.S. Cl. ..... 450/58
(58) Field of Search ..... 450/86, 87, 58, 450/70, 69, 61, 73, 59, 60

(56) References Cited

U.S. PATENT DOCUMENTS 2,054,986 A * 9/1936 Kunstadter ..... 2/42
2,378,906 A * 6/1945 Blum
2,484,440 A * 10/1949 Witkower ..... 2/42
2,970,597 A * 2/1961 Michel
3,040,750 A * 6/1962 Hurwitz
3,306,299 A * 2/1967 Paramore
3,378,013 A * 4/1968 Bruno
3,459,190 A * 8/1969 Frischer et al.
4,325,378 A * 4/1982 Wilkinson ..... 128/501
4,718,878 A 1/1988 DiTullio ..... 450/58
5,032,104 A * 7/1991 Rainville ..... 450/58
5,643,043 A * 7/1997 Pflum ..... 450/86
5,868,601 A * 2/1999 Kelemencky ..... 450/59
5,957,748 A * 9/1999 Ichiha ..... 450/58
6,149,496 A * 11/2000 Fildan ..... 450/58

FOREIGN PATENT DOCUMENTS

| | | |
|---|---|---|
| EP | 0646337 | 5/1995 |
| JP | 57-71407 | 4/1982 |
| JP | 57-74914 | 5/1982 |
| JP | 62-112304 | 7/1987 |
| JP | 2-146108 | 12/1990 |
| JP | 5-56806 | 3/1993 |
| JP | 3-69412 | 4/1995 |
| JP | 7-26322 | 9/1995 |
| JP | 7-6217 | 6/1997 |

* cited by examiner

*Primary Examiner*—Gloria M. Hale
*Assistant Examiner*—Alissa L Hoey
(74) *Attorney, Agent, or Firm*—Morrison Law Firm

(57) ABSTRACT

A tape-like connecting device adapted to firmly connect a plurality of parts of a textile product in a detachable manner, and a women's clothing product with cups using the same are provided. Both left and right cup portions are connected to each other by the tape-like connecting device. The tape-like connecting device has tape members and a connector, while the base portions of the connector are formed with depressions. The front end portions of the tape members are sewn to the center front cloths and the front end portions of the under tape by way of the depression to each other. Further, the base end portions of the tape members are sewn to cup wire portions, whereby the tape-like connecting device fulfills a main role of connecting both cup portions to each other.

14 Claims, 14 Drawing Sheets

TAPE-LIKE CONNECTING DEVICE AND WOMEN'S CLOTHING WITH CUPS

RELATED APPLICATION

The present application is a continuation-in-part application of PCT application No. PCT/JP99/02066 filed on Apr. 19, 1999, designating U.S.A. and now pending.

BACKGROUND OF THE INVENTION

1. Field of the Invention

The present invention relates to a tape-like connecting device applicable to textile products such as clothing, and women's clothing with cups using the same. The tape-like connecting device in accordance with the present invention can suitably be used as the connecting device at the center front of women's clothing with cups of front-hook type. More specifically, the women's clothing with cups in accordance with the present invention includes foundation clothing such as wire-form type brassieres, bodysuits, and three-in-ones; lingerie clothing such as bra-slips and bra-camisoles; and clothing (dresses) such as leotards, swimsuits, and bra-dresses.

2. Related Background Art

Brassieres not only have a protection function for protecting breasts but also have a bust-uplifting function for lifting up the breasts while adjusting them into good shape. Widely known as a kind of such brassieres is a wire-form type brassier in which an arc-shaped (semicircularly arced or substantially U-shaped) cup wire portion is sewn into a lower curved part of a pair of left and right cup portions covering the respective breasts. Known as such a brassiere is the one in which the respective cup cloths constituting a pair of left and right cup portions are connected to each other via a center front cloth. There has also been known a so-called front-hook type brassier in which the center front cloth is divided into left and right parts, and these left and right parts of the center front cloth are connected to each other by a detachable connector.

For example, Japanese Utility Model Application Laid-Open Nos. 57-71407 and 57-74914 disclose brassieres in which the center front parts are connected to each other by a connector which is vertically pivotable in their worn state. Also, for example, Japanese Utility Model Application Laid-Open Nos. 62-112304, 3-69412, 2-146108, and 3-6406 disclose connectors applicable to front-hook type brassieres, which are not vertically pivotable in their worn state. Further, Japanese Utility Model Application Laid-Open No. 7-6217 discloses a nursing brassiere with a connector at the center front thereof while the connector is not vertically pivotable in the worn state.

SUMMARY OF THE INVENTION

The front-hook type brassieres such as those mentioned above are advantageous in that, since the connector is located on the front side of the body (center front), wearing operations become easier for a wearer. Further, in the front-hook type brassieres employing wire forms, since cup wire portions fitting the verg's line (semicircular contour of the lower edges of breasts) are sewn therein so as to form cup portions, the shape retention and the like of the cups are improved, whereby the bust-uplifting function and volume-enhancing function are realized.

When the wearer exercises a movement accompanying the flexing or twisting of the upper half of the body, however, both cup portions are likely to shift from their initial wearing positions even if wire forms are employed. Also, when the breasts are larger (fuller) than usual or tend to descend or spread apart leftward and rightward, the sides of both cup portions are likely to shift downward after being worn.

In a front-hook type brassiere, in particular, the under-bust part tends to loosen, whereby the cup wire portion is likely to shift. Specifically, for example, a hinge-connecting type connector such as that disclosed in Japanese Utility Model Application Laid-Open No. 3-69412 is not vertically pivotable itself in the state where the brassiere is worn. In the prior art, however, a slit-like through hole is formed in the base part of each of female and male parts of the connector, and a woven fabric tape or a nonwoven fabric tab is passed therethrough to sew the connector to the center front cloth, whereby the left and right cup portions are connected to each other. As a consequence, deformations such as bending, flexure, and wrinkle are likely to occur in the tape or tab. The deformations are remarkable, in particular, in the vicinity of the part sewn to the center front cloth and the part inserted into the through hole of the connector, so that the connecting portion of the center front may float up in the state where the brassiere is worn.

As a consequence, the shape retention and stability of cups, which are characteristics of the wire-form type, may deteriorate remarkably. Therefore, the front-hook type brassieres are not widely used among women whose breasts are fuller or tend to descend or young women who regard motional functionality as important.

The circumstances mentioned above also hold true for women's clothing with cups other than the brassieres, such as bra-slips and bodysuits, for example. Namely, though it is important in the front-hook type women's clothing with cups that both cup portions be stably connected to each other at the center front and that neither forcible load nor sense of pressure be imparted to the wearer, these requirements contradict each other (being in a so-called trade-off relationship), and it has been difficult for the prior art to satisfy them at the same time.

Problems similar to those mentioned above also exist in the connection between a shoulder strap of the nursing brassiere and its corresponding cup portion, and the connection between left and right back portions at the center back. For example, in a brassiere, in which the back portions are connected to each other at the center back, the connector at the center back does not have a role of connecting left and right cup portions, which hold breasts having a fixed weight with elasticity/flexibility, to each other, or directly supporting the cup portions. However, depending on the figure of the wearer or the degree of movement, the tape or tab at the back center having the connector attached thereto is likely to deform, whereby there is a possibility of uncomfortableness or looseness occurring.

Also, in non-wire front-hook type brassieres, the conventional detachable connectors are likely to cause the tapes or tabs for supporting the connecting members to deform. Therefore, suitable and stable connections have been hard to realize. Further, it has generally been difficult to stably connect one part to another part in a detachable manner while maintaining flexibility in textile products other than women's clothing as well, thus leaving a demand for developing a new connecting technology solving these problems.

In order to solve such problems, it is an object of the present invention to provide a tape-like connecting device which is applicable to various kinds of textile products such as women's clothing with cups and can stably connect individual parts of a textile product such as both cup portions of a brassiere to each other in a detachable manner.

It is another object of the present invention to provide women's clothing with cups of a front-hook type which is excellent in easiness of putting on and taking off, without deteriorating the characteristics of the wire-form type that it is excellent in the bust-shaping property and the cup shape retention and stability, and without deteriorating the comfortability in worn state due to the looseness or dislocation.

The tape-like connecting device in accordance with the present invention comprises a pair of tape members adapted to be sewn to a woven fabric, a nonwoven fabric, or a composite fabric thereof; and a pair of connecting members disposed respectively at front ends of the pair of tape members and detachably connected to each other; wherein each of the pair of connecting members has a connecting portion and a base portion which are integrally formed from a piece of plastic, each of the base portions of the connecting members is fixed to the front end portion of each of the pair of tape members, and has at least a depression so at to allow a sewing needle to be inserted through the front end portion of the tape member.

In accordance with the present invention, since the base portions of the connecting members fixed to the front end portions of the tape members are formed with the depressions, which allow a sewing needle to be inserted through the front end portions of the tape members, the front end portions of the tape members can be sewn to a cloth of a textile product or the like, while the plastic-made connecting members themselves can firmly be attached to the cloth. Also, since the base end sides of the tape members can also be sewn to a cloth or the like, the tape-like connecting device can be attached to individual parts of the textile product stably and firmly, while the individual parts are detachable from each other by way of the connector (a pair of connecting members).

The tape-like connecting device of the present invention may be configured such that the front end portions of the pair of tape members are embedded in the base portions of the pair of connecting members, while the depressions are formed in both sides of the base portion at respective positions corresponding to each other. In such an embedding type, while the connecting members are firmly connected to the tape members, the positions of depressions in both sides correspond to each other, whereby a sewing needle can travel through these depressions so as to sew the connecting device to a cloth or the like.

In the tape-like connecting device of the present invention, the pair of connecting members may be formed by inserting front end portions of a pair of tape members into a molding die and injecting a plastic into a cavity of the molding die. In this case, since the depressions of the connecting members can automatically be formed when the position of a tape-member-pressing protrusion projecting into the cavity (hollow for injecting the plastic) is adjusted, products having the same specification can be mass-produced, whereby the cost can be cut down.

In the tape-like connecting device of the present invention, the base portions of the pair of connecting members and the front end portions of the pair of tape members may be fixed to each other by a plastic adhesive. This configuration is suitable for a low volume production of a wide variety of products since the connecting members can be formed beforehand and, in a later step, the tape members can be bonded thereto, for example, by a low-temperature adhesive.

The tape-like connecting device of the present invention may be configured such that the pair of connecting members are formed from a thermoplastic, and their base portions and the front end portions of the pair of tape members are fixed to each other by heat-melting and hardening the thermoplastic. This configuration is suitable for a low volume production of a wide variety of products at a low cost since the connecting members can be formed beforehand, melted by ultrasonic heating or the like in a later step, and then hardened after the tape members are impregnated with the plastic.

In the tape-like connecting device of the present invention, the pair of connecting members may be connected to each other so as not to be pivotable with respect to each other in a direction along a tape surface of the tape members. In this case, a plurality of individual parts of the textile product to be connected can be held stably. This configuration can suitably be utilized in wire-form type front-hook brassieres in particular.

In the tape-like connecting device of the present invention, the pair of tape members may comprise a knitted fabric, a woven fabric, or a nonwoven fabric; a composite material including a resin added to these materials; a patched body in which these materials are patched together by way of a resin; or a laminate in which one of these materials is laminated with a fiber cloth (e.g., the one in which the fiber cloth and the resin are laminated or bonded together). In this case, tape members which are highly fixable to the plastic-made connecting members and easy to be sewn to a cloth or the like can be realized at a low cost.

The women's clothing product in accordance with the present invention comprises a pair of left and right cup portions each having an arc-shaped cup wire portion sewn to a lower curved part of the cup portion; a back portion connected to side edge parts of the cup portions; a pair of left and right center front cloths having respective end portions sewn to the lower curved parts of the pair of left and right cup portions on the center front side thereof; and a tape-like connecting device having a pair of left and right tape members with their base end portions sewn to the respective cup portions on the center front side thereof, and a pair of connecting members disposed at respective front end sides of the pair of left and right tape members and detachably connected to each other so as not to be vertically pivotable with respect to each other; wherein the pair of connecting members each has a connecting portion and a base portion which are integrally formed from a plastic, each of the base portion being fixed a front end portions of each of the pair of tape members, each of the base portions being formed with at least one depression, the front end portions of the tape members being sewn to front end portions of the center front cloths by way of the depressions.

In the women's clothing product with cups in accordance with the present invention, since the front ends of the center front cloths are sewn to the tape members at the depressions of the plastic-made connecting members, the front end portions of the center front cloths can be overlaid on and secured to the front sides of the connecting members. As a consequence, the front ends of the pair of left and right center front cloths can further be drawn toward the center front, whereby the left and right cup portions can approach the center front. Also, the plastic-made connecting members can be hidden behind the center front cloths that contact the skin in the worn state, thus making it possible to improve fashionability which has tended to be inferior in the front-hook type. Further, the center front cloths and the plastic-made connecting members are directly secured to each other by way of the depression, thus making it possible to avoid the demerits of the conventional front-hook type brassiere or the like that they are open (separated backward and forward) at the front end portion.

Also, in the present invention, the base end portions of the tape members are sewn to the cup wire portions having a rigidity, together with the center front cloths, and the front end portions of the tape members are sewn to the front end portions of the center front cloths at the depressions of the plastic-made connecting members (hook) fixed thereto, while the pair of connecting members are made so as not to be pivotable. As a consequence, the tape-like connecting members and the center front cloths mutually supplement their functions of connecting both cup portions to each other, whereby the under part can be stabilized in so-called front-hook type brassieres and the like as well. Therefore, the breasts fitted into both cups as being closely lifted up together from their sides by the wearer's own hands at the time of wearing can continuously be lifted up as a whole smoothly from the verg's line side while being brought closer to each other from their sides for a long time after being worn, without being dislocated or getting out of shape, whereby a natural and beautiful bustline is continuously formed.

The women's clothing product with cups in accordance with the present invention may be configured such that the front end portions of the pair of tape members are embedded in the base portions of the pair of connecting members, while the depressions are formed in both sides of the base portion at respective positions corresponding to each other. In such an embedding type, the connecting member is firmly connected to the tape member. Also, since the positions of depressions in both sides correspond to each other, a sewing needle can travel through these depressions so as to sew the front end portion of the tape member to the front end portion of the center front cloth, and the connecting member can firmly be secured to them.

The women's clothing product with cups in accordance with the present invention may be configured such that an elastic under tape is attached to a lower edge part of the back portion, the under tape extending to lower portions of the center front cloths and being sewn thereto, the front end portions of the center cloths and front end portions of the under tape being sewn to each other by way of the depression of the connecting members. In this case, in addition to the center front cloths, the under tape is further secured to the plastic-made connecting members, whereby the tape-like connecting device, the center front cloths, and the under tape sewn thereto are united together and function as the connecting portion between both cup portions. In particular, since the under tape substantially loses its elasticity as being sewn to the nonelastic center front cloths, the three-dimensional shaping effect caused by sidewise centering and the stability would further improve.

The women's clothing with cups in accordance with the present invention may be characterized in that the base end portions of the tape members are sewn to respective lower edge parts of the cup portions on the center front sides thereof, and the lower edge parts of the cup portions, the under tape, and the tape-like connecting device are positioned on substantially an identical plane in the worn state. In this case, the cup wire portions attached to the left and right cup portions are connected to each other in a further stable state, whereby the shaping property and shape retention would further improve. Namely, since the tensile force generated by the elastic back portion at the time of wearing is exerted in the direction of a curve (a direction along the under bust of the wearer) on substantially an identical plane connecting the lower portions of the lower curved parts of the cup portions having the cup wire portions attached thereto and the tape-like connecting device disposed therebetween, the upper parts of the cup portions are stabilized without being pulled rightward and leftward due to the bulge and weight of the breasts, whereby an excellent sidewise centering effect can be realized without constraint.

In the women's clothing product with cups in accordance with the present invention, the sewn position between the cup portions and the tape members may be shifted toward the center front from the sewn position between the cup portions and the under tape. In this case, the plastic-made connector (a pair of connecting members) is positioned at the apex of a triangle whose base is the cup wire portion held between these two sewn positions, whereby the stableness of the center front at the time of wearing would enhance.

In the women's clothing product with cups in accordance with the present invention, the plastic-made connector constituted by a pair of connecting members may be hinged together with a maximum opening of 180° on the skin side. In this case, the connecting structure can be prevented from bending at its middle portion (the part corresponding to the connector) toward the front side (the side opposite to the skin) at the time of wearing, and the wearing action itself is easy.

The women's clothing product with cups in accordance with the present invention may be configured such that the tape-like connecting device has a width greater than that of the wire bias of the cup wire portion but not greater than 25 mm. When it is thus made broader than the width of the wire bias, then the connection between both cup wire portions can be prevented from becoming insufficient. Also, when it is thus set to 25 mm or less, then the independent relative movements of both cup wire portions caused by movements of the wearer can be restrained from being restricted in excess.

In the women's clothing product with cups in accordance with the present invention, the pair of connecting members may be formed by inserting front end portions of a pair of tape members into a molding die and injecting a plastic into a cavity of the molding die. In this case, since the depression of the connecting member can automatically be formed when the position of a tape-member-pressing protrusion projecting into the cavity (hollow for injecting the plastic) is adjusted, products having the same specification can be mass-produced, whereby the cost of the women's clothing product with cups can be cut down. Also, since the fixed portion between the plastic-made connecting members and the connecting tapes can be made thin, its feel is favorable.

In the women's clothing product with cups in accordance with the present invention, the base portions of the pair of connecting members and the front end portion of the pair of tape members may be fixed to each other by a plastic adhesive. Since the connecting members can be formed beforehand and, in a later step, the tape members can be bonded thereto, for example, by a low-temperature adhesive, various kinds of tape-like connecting devices can be prepared, whereby this configuration is suitable for a low volume production of a wide variety of women's clothing products with cups.

The women's clothing product with cups in accordance with the present invention may be configured such that the pair of connecting members are formed from a thermoplastic, and their base portions and the front end portions of the pair of tape members are fixed to each other by heat-melting and hardening the thermoplastic. Since the connecting members can be formed beforehand, melted by ultrasonic heating or the like in a later step, and then hardened after the tape members are impregnated with the plastic, various kinds of tape-like connecting devices can be prepared, whereby this configuration is suitable for a low volume production of a wide variety of women's clothing products with cups at a low cost.

In the women's clothing product with cups in accordance with the present invention, the pair of tape members may comprise a knitted fabric, a woven fabric, or a nonwoven fabric; a composite material including a resin added to these materials; a patched body in which these materials are patched together by way of a resin; or a laminate in which one of these materials is laminated with a fiber cloth (e.g., the one in which the fiber cloth and the resin are laminated or bonded together). In this case, tape members which are highly fixable to the plastic-made connecting members and easy to be sewn to the center front cloths and cup wire portions can be realized at a low cost, and their feel can be improved.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE INVENTION

DESCRIPTION OF THE PREFERRED EMBODIMENTS

In the following, the tape-like connecting device in accordance with embodiments of the present invention, and embodiments of the brassiere employing the same will be explained with reference to the accompanying drawings. In the explanation of the drawings, constituents identical to each other will be referred to with numerals or letters identical to each other without repeating their overlapping descriptions. Also, in the specification, words such as "upper", "lower", "left (L)", "right (R)", "front", and "back" are based on the state where the clothing product is worn in the standing posture.

Figure 1:
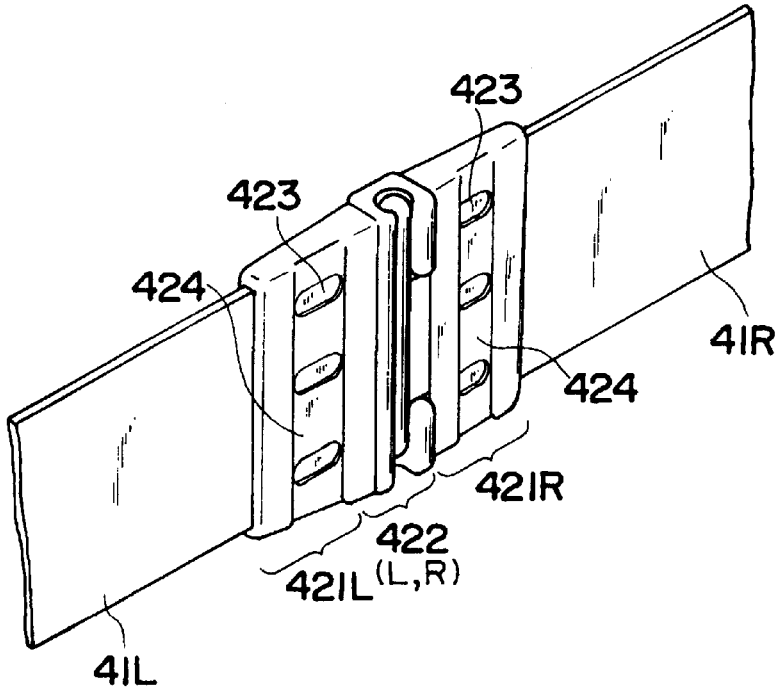
FIG. 1 is a perspective view of the tape-like connecting device in accordance with an embodiment.
Figure 2:
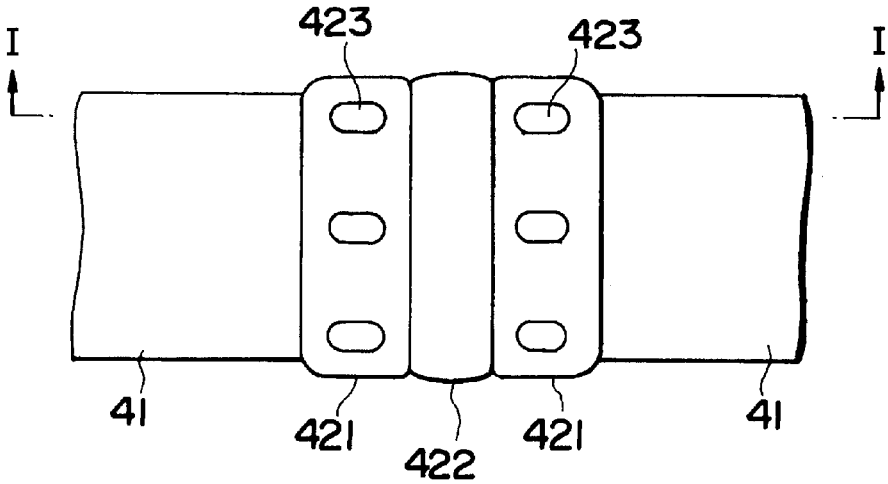
FIG. 2 is a rear view of the tape-like connecting device of FIG. 1.
Figure 3:
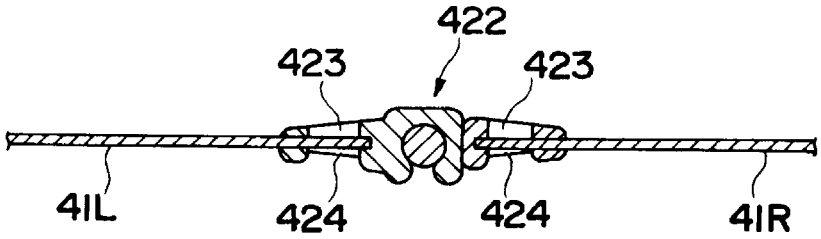
FIG. 3 is a sectional view taken along the line I—I of FIG. 2.
Figure 4:
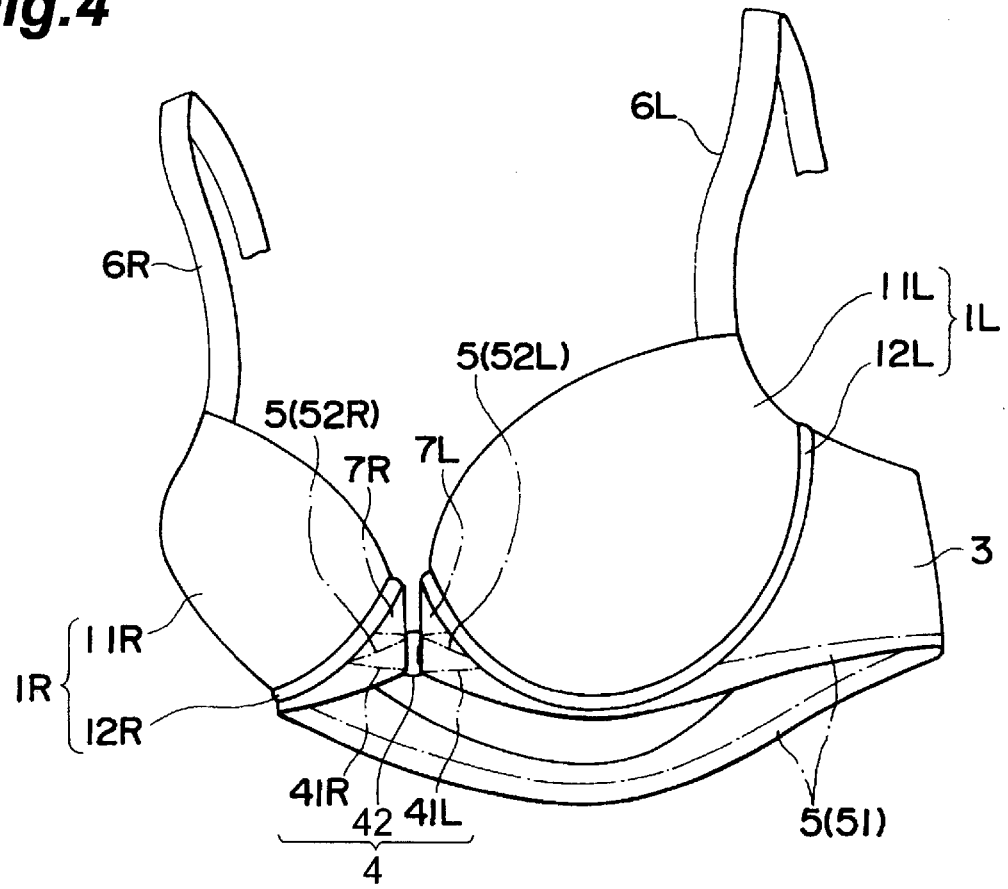
FIG. 4 is a perspective view of the brassiere in accordance with an embodiment.
Figure 5:
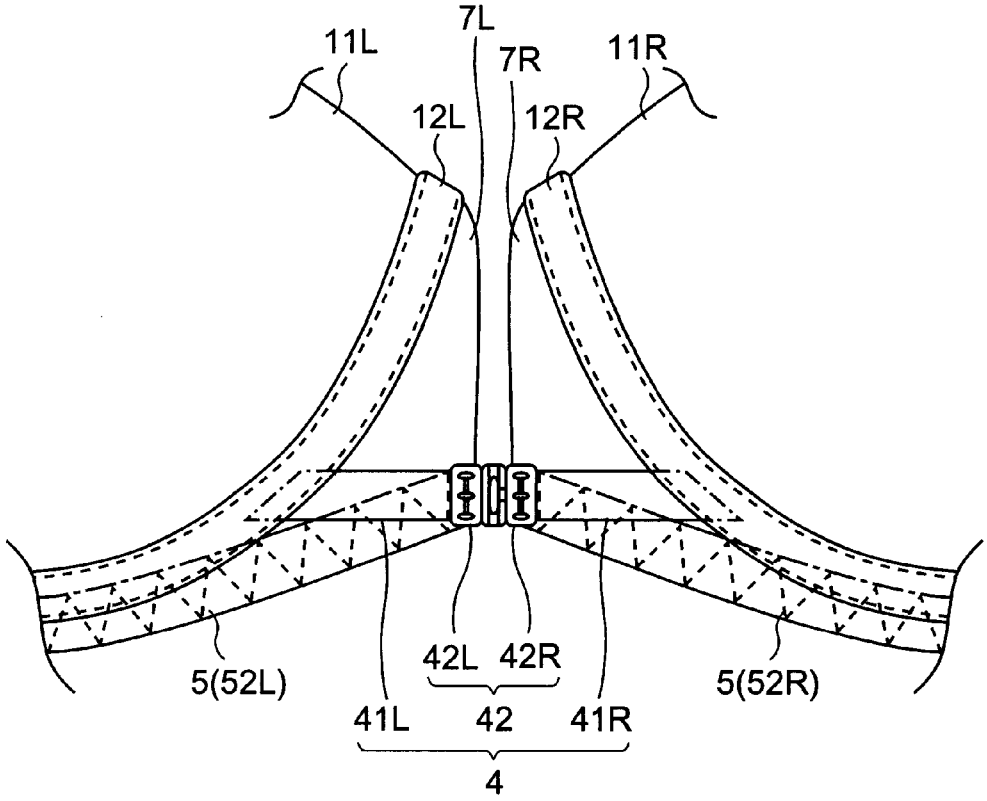
FIG. 5 is a view showing the center front portion of the brassiere shown in FIG. 4, as observed from the skin side.
Figure 6:
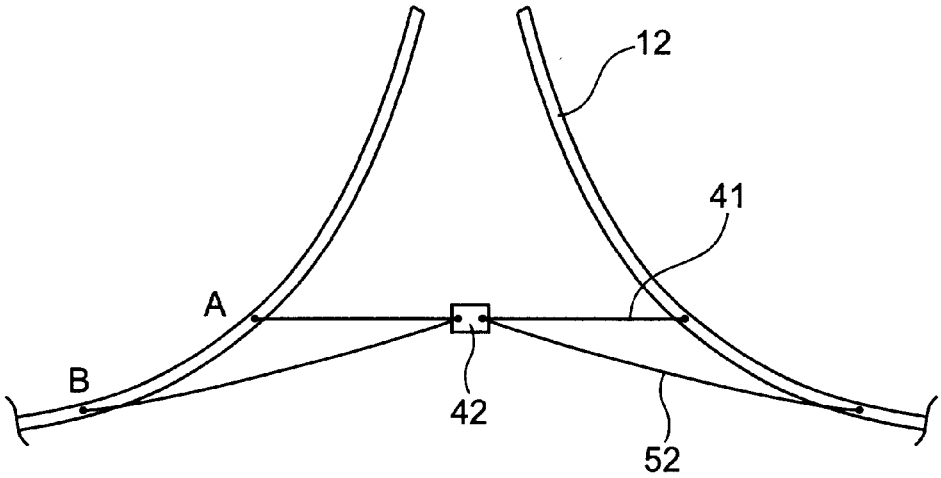
FIG. 6 is a view for schematically explaining the operation of the connecting mechanism shown in FIG. 5.

FIG. 1 is a perspective view for explaining the configuration of the tape-like connecting device in accordance with an embodiment of the present invention; FIG. 2 is a front view of this tape-like connecting device; FIG. 3 is a sectional view of the tape-like connecting device taken along the line I—I of FIG. 2; and FIG. 4 is a perspective view showing a first embodiment of the front-hook type brassiere in which this tape-like connecting device is used for the connection at the center front. FIG. 5 is a front view showing the vicinity of the center front of this brassiere as observed from the skin side; and FIG. 6 is a view schematically showing the connecting mechanism of FIG. 5. Here, the edge parts of the members located on the rear side of other members are indicated by chain lines, whereas sewn parts (the parts corresponding to sewing threads) are indicated by broken lines.

For easier understanding, the overall configuration of the brassiere in accordance with an embodiment will be explained first. As shown in FIG. 4, left and right cup portions 1L, 1R are connected to each other by a tape-like connecting device 4. The tape-like connecting device 4 has connecting tapes 41L, 41R and a connector 42 with depressions formed in its base portions. The front end portions of the connecting tapes 41L, 41R are sewn to the center front cloths 7L, 7R and the front end portions of the under tape 5 by way of the depressions. Further, the base end portions of tape members 41L, 41R are sewn to cup wire portions 12L, 12R, whereby the tape-like connecting device 4 fulfills a main role of connecting both cup portions 1L, 1R to each other.

In detail, each of the pair of left and right cup cloth portions 11L, 11R covering their corresponding breasts is formed by lower and upper cup cloths (not distinctively depicted) which are sewn to each other. Cup wire portions 12L, 12R, each including a semicircularly arced wire (not depicted) inserted therein, are sewn to the respective lower edge curved parts (lower curved edge parts) of the cup cloth portions 11L, 11R. The wires are formed from metal such as a shape-memory alloy, a rigid plastic, or the like, and have such a form as to favorably fit to the verg's line of breast. The wires are sewn while being surrounded by bias tapes made of a soft material such as a nonwoven fabric. The above-mentioned cup cloth portions 11L, 11R and the cup wire portions 12L, 12R constitute a pair of left and right cup portions.

A back portion 3 made of an elastic knitted fabric is sewn to side edge parts of the cup wire portions 12L, 12R, whereas an under tape 5 having an elasticity provided by a rubber or the like is sewn to the lower edge of the back portion 3. Elastic shoulder straps 6L, 6R, the lengths of which are adjustable, are hung between the upper end parts of the cup cloth portions 11 and the back side of the back portion 3.

As shown in FIG. 5 in detail, the base end parts of center front cloths 7L, 7R are sewn to the center front sides of the left and right cup portions 1L, 1R, i.e., the center front sides of the cup wire portions 12L, 12R, respectively, whereas the above-mentioned under tape 5 extending leftward and rightward is sewn to the lower edges of the pair of left and right front center cloths 7L, 7R. Namely, the rear portion 51 of under tape 5 sewn to the lower edge of the left or right back portion 3 is an elastic tape material integral with the front portions 52L, 52R of under tape 5 sewn to the lower edge of the center front cloths 7L, 7R, and is also sewn to the lower ends of the cup wire portions 12L, 12R.

The characteristics of the brassiere in accordance with this embodiment, as compared with conventional ones, lies in that a tape-like connecting device 4, whose detailed configuration is shown in FIGS. 1, 2, and 3, is disposed as a front connector of the brassiere on the skin side of the center front cloths 7L, 7R as shown in FIGS. 4 and 5. As shown in FIGS. 1, 2, and 3, the tape-like connecting device 4 comprises a pair of connecting tapes 41L, 41R, and a pair of female and male connecting members 42L, 42R. The front end portions of the connecting tapes 41L, 41R are fixed to flat base portions of the connecting members 42L, 42R. The female and male connecting members 42L, 42R comprise respective flat base portions 421L, 421R and respective connecting portions 422L, 422R which are integrally formed from a plastic. The front end portions of the connecting tapes 41L, 41R are respectively embedded into and fixed to the base portions 421L, 421R of connecting members 42L, 42R as shown in FIG. 3. Three vertically aligned depressions 423L and three vertically aligned depressions 423R are formed respectively in base portions 421L, 421R, whereas the surfaces of the connecting tapes 41L, 41R are exposed at the bottoms of the depressions.

The tape-like connecting device 4 shown in FIGS. 1, 2, and 3 is attached to a brassiere as shown in FIG. 4. Namely, both ends (base ends) of the connecting tapes 41L, 41R are sewn to the lower parts of the left and right cup wire portions 12L, 12R on the center front sides thereof, whereas the base portions 421L, 421R of the connecting members 42L, 42R and the front end portions of the connecting tapes 41L, 41R are sewn to the front end portions of the center front cloths and the front portions 52L, 52R of under tape 5 by way of three depressions 423 in each of connecting members 42L, 42R. Each of the back sides of the base portions 421L, 421R is formed with a shallow recessed groove 424 which extends vertically and connects the three depressions 423 to each other (see FIGS. 1 and 3). As the three depressions 423 align within the recessed groove 424, the sewing thread is accommodated in the latter.

In other words, each of the back side of the base portions 421L, 421R is formed with a vertically extending recessed groove 424, within which the three depressions 423 are formed. As a consequence, the sewing thread hung between the depressions is accommodated within the recessed groove. Also, the surfaces of the connecting tapes 41L, 42R are exposed only at the recessed surface portions of the depressions 423 in the recessed groove 424, without being exposed at any other portion of the recessed groove. Therefore, when the connecting tapes 41L, 41R are sewn to the front portions 52L, 52R of under tape 5, the base portions 421L, 421R are sewn together therewith at the same time, so as to be connected firmly.

Further, the recessed grooves 424 extend along a vertical direction (the longitudinal direction of the groove), so as to reach both end parts of the base portions 421L, 421R, while opening at both end portions of the recessed grooves. As a consequence, even if a sewing thread is hung such that one part of the thread passes through the depressions within the base portions 421L, 421R while the other travels outside the base portions 421L, 421R when being sewn to the front portions 52L, 52R of under tape 5, the sewing thread will be accommodated within the recessed grooves 424.

Here, the female and male connecting members 42L, 42R are made so as not to be pivotable in the tape surface direction in their connected state. The connecting tapes 41L, 41R are shaped into substantially a trapezoidal form, with both ends being cut obliquely (see FIG. 5). At the hypotenuse portions of the trapezoid, from the upper side to the lower side, the connecting tapes 41L, 41R are sewn to the bias tapes of the cup wire portions 12L, 12R and cup cloth portions 11L, 11R of both cups, and the center front cloths. Further, while the front portions 52L, 52R of under tape 5 are sewn, along their upper and lower sides, to the center front cloths 7L, 7R, the connecting tapes 41L, 41R are not sewn thereto in the middle portion excluding their base end and front end portions. Furthermore, the front portions 52L, 52R of under tape 5 have substantially lost their elasticity as being sewn to and united with the center front cloths 7L, 7R in an overlapping manner along the longitudinal direction, whereas the connecting tapes 41L, 41R are constituted by a material having substantially no elasticity.

Operations of the brassiere in accordance with the first embodiment shown in FIGS. 1 to 5 will now be explained. In this embodiment, since the front end portions of the center front cloths 7L, 7R (the front end portions of the front portions 52L, 52R of under tape 5 sewn to the lower edges of the center front cloths 7L, 7R) are sewn to the front end portions of the connecting tapes 41L, 41R by way of the depressions 423 formed in the base portions 421L, 421R of the plastic-made connector 42, the front ends of front portions 52L, 52R of under tape 5 and center front cloths 7L, 7R can be secured to the front side of the connector 42 in an overlapping manner. As a consequence, the front ends of the pair of left and right center front cloths 7L, 7R can further be drawn toward the center front, whereby the left and front cup portions 1L, 1R can be caused to approach the center front and stabilized.

Also, as shown in FIG. 5, since the front center cloths 7L, 7R are sewn to the front side of the connector 42 in an overlapping manner, the plastic-made connector 42 can be hidden between the center front cloths 7L, 7R and the skin in the worn state. While the decorative value of the conventional front-hook type brassiere has tended to become inferior due to the fact that its unfashionable connector can be seen from the front side, fashion ability can be improved in the present invention as the connector is hidden behind the decorated center front cloths 7L, 7R.

Also, if the connector is to be hidden between the center front cloths and the skin in the conventional front-hook type brassiere, then the following will occur. Namely, the center front cloths are sewn to the connecting tapes fixed to the connector, without being sewn to the connector in the vicinity of the respective front ends on the connecting sides, at the position slightly in front of the above-mentioned front ends of the center front cloths (the position dislocated sideward (outward) from the connecting position between the left and right connecting members). Then, the connector is to be hidden by the part not secured to its surroundings, i.e., by the unsewn part between the sewn positions of the center front cloths and the above-mentioned front ends. As a consequence, the distance from the sewn positions of the center front cloths to the front ends of the center front cloths becomes longer, whereby the connector and the center front cloths would open (separate backward and forward from each other) about the sewn position.

In this embodiment, the front end portions of the center front cloths 7L, 7R in the vicinity of their end sides and the front end portions 52L, 52R of the under tape 5 in the vicinity of their end sides are directly fixed to the connector 42 by a sewing thread by way of the depressions 423 formed in the base portions 421L, 421R. As a consequence, there is substantially no unsewn part at the front ends of the center front cloths 7L, 7R, thus eliminating the inconvenience of the front end portions of the center front cloths 7L, 7R and the connector 42 opening backward and frontward at the front end portions.

Namely, in this embodiment, not only the distances from the sewn position between the connector and the center front cloths to their front ends can be shortened, but also the plastic-made connector 42 itself can be secured to the center front cloths 7L, 7R and the front portions 52L, 52R of under tape 5 by a sewing thread, whereby the above-mentioned inconvenience can be avoided.

Also, in this embodiment, as shown in FIG. 5, the tape-like connecting device 4 is sewn, at both ends of its connecting tapes 41L, 41R, to the cup wire portions 12 having a rigidity, whereas the front portions 52L, 52R of under tape 5 having substantially lost the elasticity as being sewn to the center front cloths 7L, 7R are also sewn to the cup wire portions 12L, 12R. As a consequence, both of the tape-like connecting device 4 and front portions 52L, 52R of under tape 5 function to connect the left and right cup portions 1L, 1R.

Characteristically, in this embodiment, the sewn positions between the connecting tapes 41L, 41R and the cup wire portions 12L, 12R are located at positions shifted toward the center front from the sewn positions between the front portions 52R, 52L of under tape 5 and the cup wire positions 12L, 12R, while both of the front ends of the front portions 52L, 52R of under tape 5 and the front end portions of the connecting tapes 41L, 41R are fixed to the plastic-made connecting members (the female/male connecting members 42L, 42R that constitute the connector 42) by a sewing thread and are made so as not to be pivotable in the direction along the tape surface, whereby the left and right cup portions 1L, 1R are connected to each other by the connector 42 located at the apex of the triangle whose bottom side is the cup wire portion 12 as schematically shown in FIG. 6. Consequently, when receiving a tensile force upon elongation of the elastic rear portion 51 of under tape 5 or the back portion 3 itself at the time of wearing, the tape-like connecting device 4 and the front portions 52L, 52R of under tape 5 apply forces to the cup wire portions 12L, 12R along their tape surfaces, without generating a large torsional deformation or flexure.

The tensile forces in the side wise separating direction caused by the elongation of the rear portion 51 of under tape 5 and back portion 3 are widely applied to the tape-like connecting device 4 and front portions 52L, 52R of under tape 52 along their longitudinal directions, with nonuniform strength. In the worn state, the tensile force along the tape-like connecting device 4 is usually greater than that along the front portions 52L, 52R of under tape 5. It is due to the fact that, while the breasts are lifted up while being centered from their sides by the wearer's own hands so as to fit inside the cup portions 1L, 1R at the time of wearing (the initial stage of wearing), the both cup portions 1L, 1R are provided with a counterforce in the direction of opening them downward (the counterforce caused by the bulge of breasts and the shaping thereof) in the worn state as a reaction to the action of continuously centering and lifting up the breasts (the action of centering in particular). As a result, there is a tendency that, about the lower parts of the cup wire portions 12L, 12R on the center front sides, the sides thereof are pushed outward therebelow, whereas the center front sides therefore are pushed upward.

When the reaction (the counterforce from the breasts) caused by this "centering/uplifting" is strong (e.g., when the wearer is exercising or a pressure is received from the outside), the tensile forces applied to the tape-like connecting device 4 and front portions 52L, 52R of under tape 5 in the sidewise separating direction would greatly be out of balance. In this embodiment, however, since the left and right cup portions 1L, 1R are connected to each other by the connector 42 located at the apex of the triangle constituted by the nonelastic tape-like connecting device 4, the front portion 52 of under tape 5 having lost its elasticity, and the cup wire portion 12 having a rigidity (see FIG. 6), the connecting tapes 41L, 41R and the front portions 52L, 52R of under tape 5 stably hold the cups at their initial wearing positions, without generating extreme deformation or large torsional deformation, and consequently without deteriorating the centering/uplifting function.

When the wearer exercises a movement accompanying a twist of the upper half of body or receives a pressure to one of the breasts, then the left and right breasts move independently from each other within a fixed range. In this embodiment, however, the cup wire portions 12L, 12R are held by the connecting tapes 41L, 41R and front portions 52L, 52R of under tape 5 extending to the plastic-made connector from two sewn positions (the positions A, B in FIG. 6), and the connecting tapes 41L, 41R and front portions 52L, 52R of under tape 5 constituting the two hypotenuses of the respective triangles can freely move at their middle parts between the front and base ends thereof, where they are not sewn to each other. As a consequence, dislocation or the like would not occur in the cup wire portions 12L, 12R, and the initial state is restored when the wearer resumes the normal posture (the posture before the exercise) or is released from the biased pressure.

Further, in this embodiment, the center front cloths 7L, 7R can be made smaller (into a narrower area), or the connecting position of the connector 42 can be shifted downward. Namely, if both cup wire portions 12L, 12R are connected to each other by the center front cloths 7L, 7R and the front portions 52L, 52R of under tape 5 alone, then they cannot be held with a fixed positional relationship against the unbalanced tensile forces applied to the upper and lower sides of the connecting portion. Therefore, in the conventional brassiere, center front cloths 7L, 7R having a large vertical width have been sewn to both cup wire portions 12L, 12R from their upper part on the center front side (terminal) to the lower part, or center front cloths 7L, 7R having a narrow vertical width have been sewn to the middle parts between the upper and lower parts on the center front side such that tensile forces are uniformly applied to the upper and lower sides. In this embodiment, since the connecting tapes 41L, 41R and front portions 52LO, 52R of under tape 5 each having no elasticity in the longitudinal direction are provided so as to constitute two sides of each triangle, even when the "lower parts" of both cup wire portions 12L, 12R on the center front side are connected to each other, these connecting mechanisms, without loosing their shape, would hold both cup portions 1 with a fixed positional relationship.

Due to these operations, the function of continuously lifting up the breasts while centering them from their sides is fully exhibited in the worn state, and an excellent three-dimensional bust-shaping property is yielded without looseness. Also, since the function of preventing the cup portions 1L, 1R from dislocating in the direction along which the shoulder straps 6L, 6R come off toward the arms is exhibited at the same time, excellent shape retention and stability are yielded. Therefore, excellent feel of wear, comfortability, bust-uplifting function, and volume-enhancing function can be realized at the same time.

The above-mentioned centering/uplifting function and stabilizing effect for the under part according to this embodiment are considered to become more remarkable as the wearer has fuller breasts. As a consequence, the problems inherent in the conventional front-hook type brassiere can be improved greatly. Namely, the front-hook type brassiere has not recently been in wide use, since the under part tends to loosen and, consequently, it becomes inferior in terms of three dimensional shaping function and motional functionality when the breasts are fuller. This embodiment overcomes such conventional demerits, thus making it possible to realize a front-hook type brassiere which does not loosen the under part, attains a tightness during and after exercises as well, and exhibits a high centering/uplifting function.

In this embodiment, the width of the connecting tapes 41L, 41R is larger than the width of the cup wire portions 12L, 12R (wire bias), preferably by 1.1 to 2.5 times, more preferably by 1.3 to 2.0 times. Specifically, the width of the connecting frame is 0.7 to 2.8 cm, desirably on the order of 0.8 to 2.5 cm. If the width of the connecting tapes 41L, 41R is narrow, e.g., on a par with the wire bias or shorter, then the direction of the force acting on the cup wire portions 12L, 12R when a tensile force is applied thereto at the time of wearing becomes unstable, whereby the shaping function deteriorates. If the connecting tapes 41L, 41R are too wide, on the other hand, then the movement of the center front sides of the cup wire portions 12L, 12R are restricted in excess, whereby the breasts are pressed so much that they are constrained, and inconveniences such as deterioration of feel of wear will occur.

Also, in the worn state of the brassiere in accordance with this embodiment, the rear portion 51 of under tape 5 sewn to the lower side of the back portion 3 and the lower part of the connector are positioned on substantially the same horizontal plane extending along the under bust, and the lower parts of the cup wire portions 12L, 12R are located slightly below this horizontal plane, whereby they are positioned along an ellipsoid on substantially the same horizontal plane (the chest surface along the under bust). As a consequence, when the rear portion 51 of under tape 5 elongates together with the back cloth 3 at the time of wearing, its resulting tensile force is transmitted along the above-mentioned "substantially the same horizontal plane." Thus, without being drawn leftward or rightward by the weight or bulge of breasts, the cup portions 1L, 1R are stabilized at their initial wearing positions, so as to keep slim side lines.

Also, since the connecting tapes 41L, 41R have a sufficient flexibility, the brassiere of this embodiment has a high safety with respect to the body of the wearer, whereby there is no obstruction when accommodating and storing the brassiere by folding it at the center front, and no particular care is necessary for its washing. Further, since this embodiment can easily be manufactured by simply sewing the tape-like connecting device 4, which is easily available at a low cost, to the cup wire portions 12L, 12R, the cost would not particularly rise up in terms of material or manufacturing process.

Moreover, since the lower parts of both cup portions are connected to each other by the tape-like connecting device 4, the center front cloths 7L, 7R can deeply be cut into a V-shape from the center front side terminals of the cup wire portions 12L, 12R to the lower sides. As a consequence, clothing whose center front is deeply cut in so as to emphasize the valley of bust (e.g., V neck or tailor collar clothes) can be worn as outerwear, whereby the practicability and versatility of the brassiere as foundation clothing can be enhanced.

As the connecting tapes 41L, 41R, this embodiment employs, for example, a knitted fabric in which natural or synthetic fiber yarns are plain-woven, for example, as warp and weft. It may be a nonwoven fabric made of natural or synthetic fiber, or a knitted fabric such as power net or tricot as well. Also, it may be an unstretched composite material including a resin added thereto, such as the one in which the above-mentioned materials are impregnated with the resin, or a patched material in which woven fabrics or nonwoven fabrics of the same or different kinds are overlaid on one another in two or more layers and sewn or bonded together (e.g., fiber cloths and the resin are laminated or bonded together). In particular, when fiber cloths such as woven fabrics of yarns and nonwoven fabrics are patched together on the skin side, favorable feel can be realized.

The brassiere in accordance with modified examples of the first embodiment will now be explained with reference to FIGS. 7 to 11.

Figure 7:
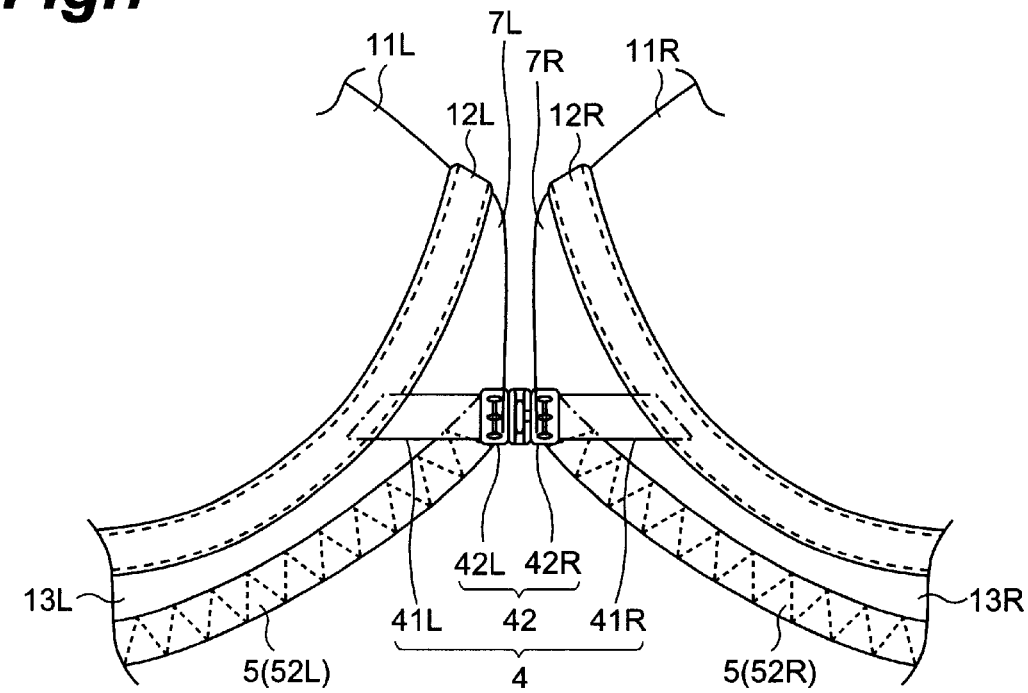
FIG. 7 is a view showing the center front portion of the brassiere in accordance with a first modified example, as observed from the skin side.

FIG. 7 is a view showing the vicinity of the cup connecting portion in the brassiere in accordance with a first modified example as observed from the skin side. As depicted, a pair of left and right center front cloths 7L 7R are sewn to cup wire portions 12L, 12R from the center front side terminals of the cup wire portions 12L, 12R to the lower ends thereof. The center front cloths 7L, 7R are continuous with cup lower cloths 13L, 13R continuously extending from the lower sides of both cup portions 1L, 1R to their sides, whereas the cup lower cloths 13L, 13R are sewn to an elastic back portion 3 at side portions thereof. Also, the-front portions 52L, 52R are sewn to the lower edges of the cup lower cloths 13L, 13R, and extend to the lower edges of the back cloth 3 by way of the lower edges of the cup lower cloths 13L, 13R.

Characteristically, in this first modified example, the base end portions of the connecting tapes 41L, 41R are sewn to the middle part between the lower edges and terminals of the cup wire portions 12L, 12R, whereas the connector 42 at the front end portion is secured to the front ends of the front portions 52L, 52R of under tape 5 by a sewing thread as with the above-mentioned embodiment. Also, as with the above-mentioned embodiment, the connecting tapes 41L, 41R are substantially horizontal in the worn state. The other parts of configuration will not be explained here, since they are similar to those in the above-mentioned embodiment.

The tape-like connecting device 4 and the front portions of under tape 5 having lost its elasticity mutually supplement their connecting functions in this modified example as well. As compared with the above-mentioned embodiment, however, the angle formed between the tape-like connecting device 4 and the front portion 52L, 52R of under tape 5 is greater, and the tape-like connecting device 4 extends substantially horizontally, whereby the tensile force mainly applies to the tape-like connecting device 4.

According to the first modified example, a simple structure in which the tape-like connecting device 4 is disposed on the skin-contacting side of the center front cloths 7L, 7R can also realize an excellent shaping function, high motional functionality, and excellent fashionability. In particular, the stability of cups can be improved when the rigidity of the cup lower cloths 13L, 13R is made higher than that of the cup cloths 11L, 11R or center front cloths 7L, 7R.

Figure 8:
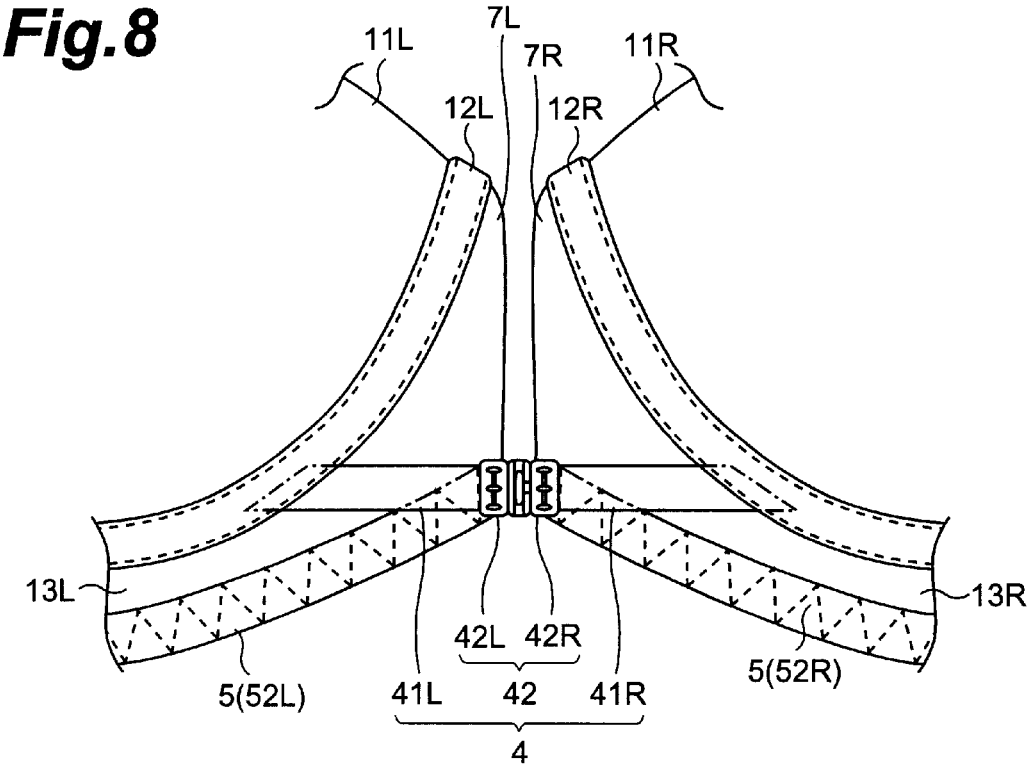
FIG. 8 is a view showing the center front portion of the brassiere in accordance with a second modified example, as observed from the skin side.

FIG. 8 shows a second modified example. It differs from the first modified example in that the tape-like connecting device 4 is disposed in the vicinity of the lower edge portions of the cup wire portions 12L, 12R. The second modified example can also realize an excellent shaping function, high motional functionality, and excellent fashionability by a simple structure. In particular, the stability of cups can be improved when the rigidity of the cup lower cloths 13L, 13R is made higher than that of the cup cloths 11L, 11R or center front cloths 7L, 7R.

Figure 9:
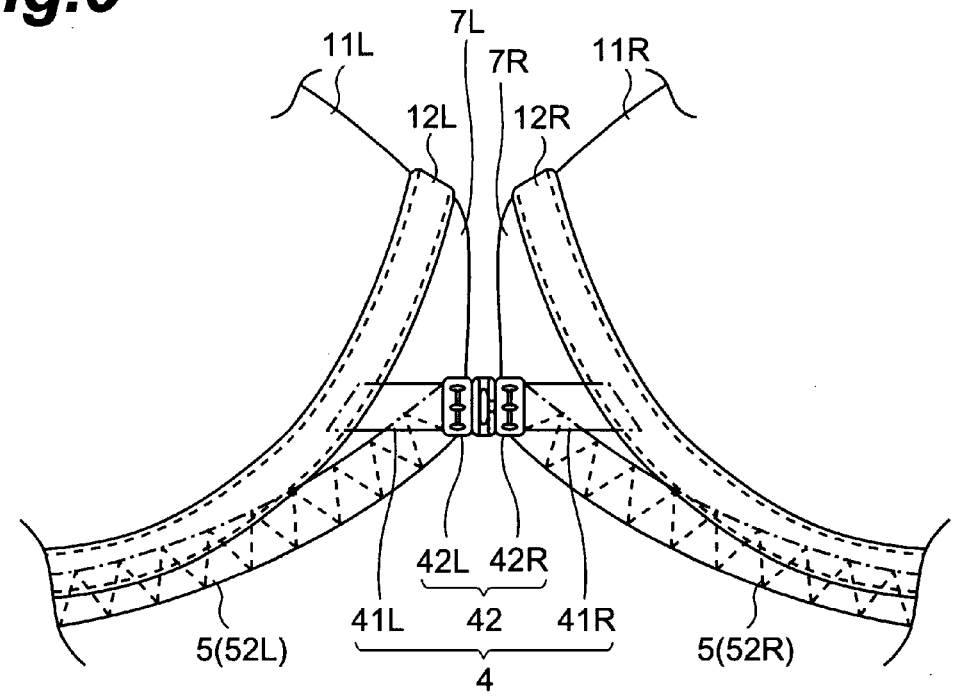
FIG. 9 is a view showing the center front portion of the brassiere in accordance with a third modified example, as observed from the skin side.

FIG. 9 shows a third modified example. It differs from the embodiment shown in FIG. 4 in that the tape-like connecting device 4 is disposed at a position shifted toward the terminal portions of the cup wire portions 12L, 12R (shifted upward). According to the third modified example, while the front portions 52L, 52R of under tape 5 acts less in the connection between the left and right cup portions 1L, 1R, the tape-like connecting device 4 fulfills a main role, whereby an excellent shaping function, high motional functionality, and excellent fashionability can be realized by a simple structure.

Figure 10:
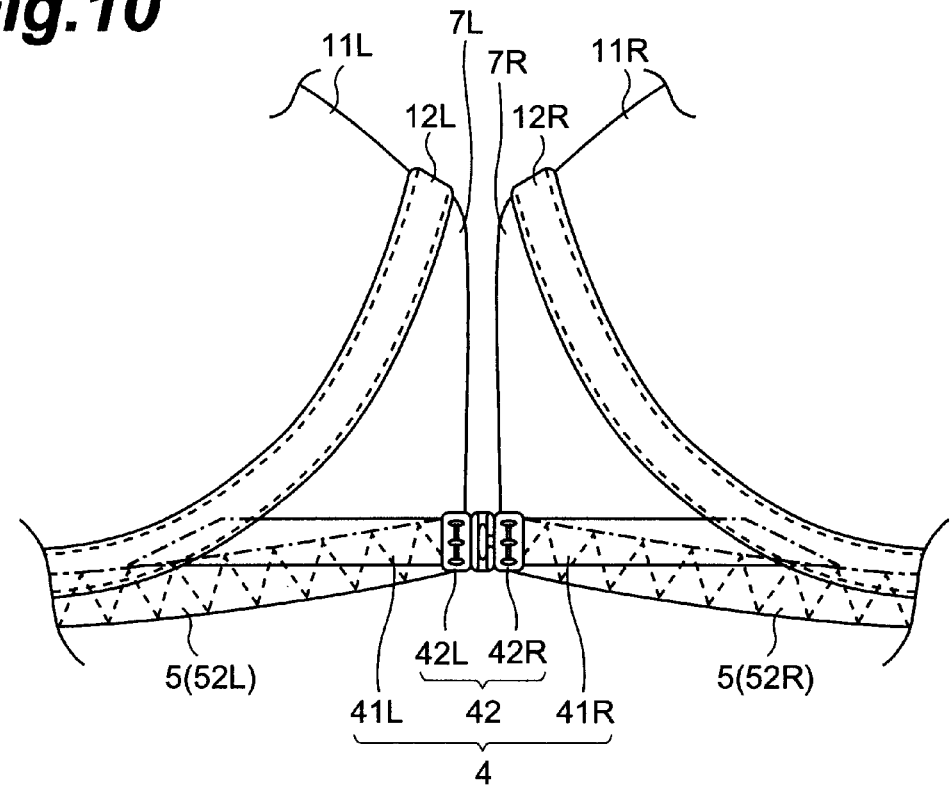
FIG. 10 is a view showing the center front portion of the brassiere in accordance with a fourth modified example, as observed from the skin side.
Figure 11:
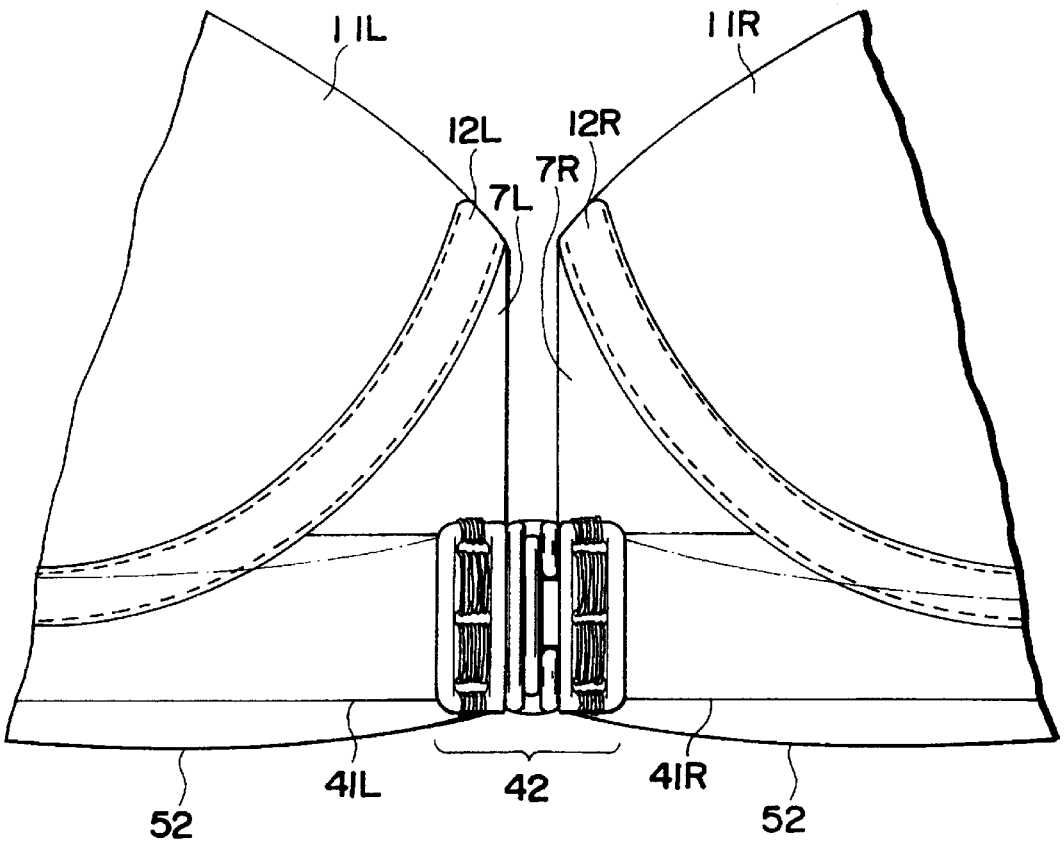
FIG. 11 is a view showing the center front portion of the brassiere in accordance with another modified example, as observed from the skin side.

FIG. 10 shows a fourth modified example. It differs from the third modified example in that the tape-like connecting device 4 is disposed in the vicinity of the lower edge parts of the cup wire portions 12L, 12R. The fourth modified example can also realize an excellent shaping function, high motional functionality, and excellent fashionability by a simple structure. For example, when the width of the tape-like connecting device 4 is made relatively greater as compared with the cup wire portions 12L, 12R as shown in FIG. 11, then the stability of the left and right cup portions 1L, 1R in the worn state enhances.

Without being restricted to the above-mentioned embodiment, the women's clothing product with cups in accordance with the present invention can employ various kinds of modes.

Though the above-mentioned embodiment relates to the brassiere as foundation clothing, it is applicable to various kinds of women's clothing with cups of wire-form type. For example, it is applicable to bra-slips, bra-camisoles, three-in-ones, bodysuits, leotards, swimsuits, bra-dresses, and the like.

Also, the shoulder straps are not essential, and the present invention is also applicable to strapless type brassieres and the like. Also, without the cup portions being limited to those of ¾ cups, the present invention is also applicable to full-cup and half-cup brassieres or the like.

The present invention is also applicable to a two-part split type brassiere having connectors on both rear and front sides. Here, the connecting tape 41L, 41R are not limited to a tape material having a completely identical width in their longitudinal direction but may be a tape material whose width is broadened by the order of 10% to 20% at the base end portion (at the end part on the cup wire portion side in particular).

The tape-like connecting device in accordance with an embodiment of the present invention will now be explained with reference to FIGS. 12A to 16.

Figure 12A:
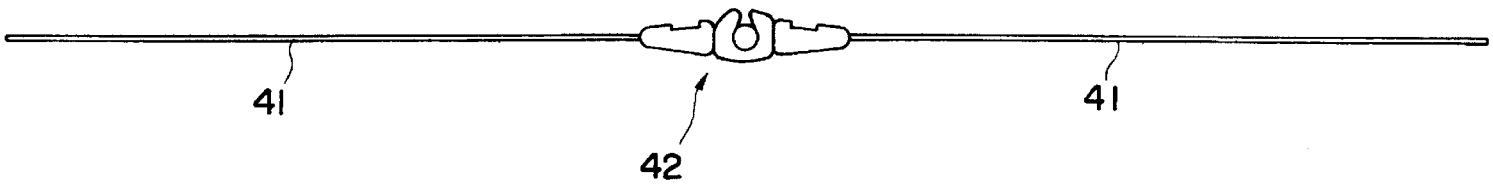
FIGS. 12A to 12C are views for showing the tape-like connecting device in accordance with an embodiment, which are its plan view, front view, and bottom view, respectively.
Figure 12B:
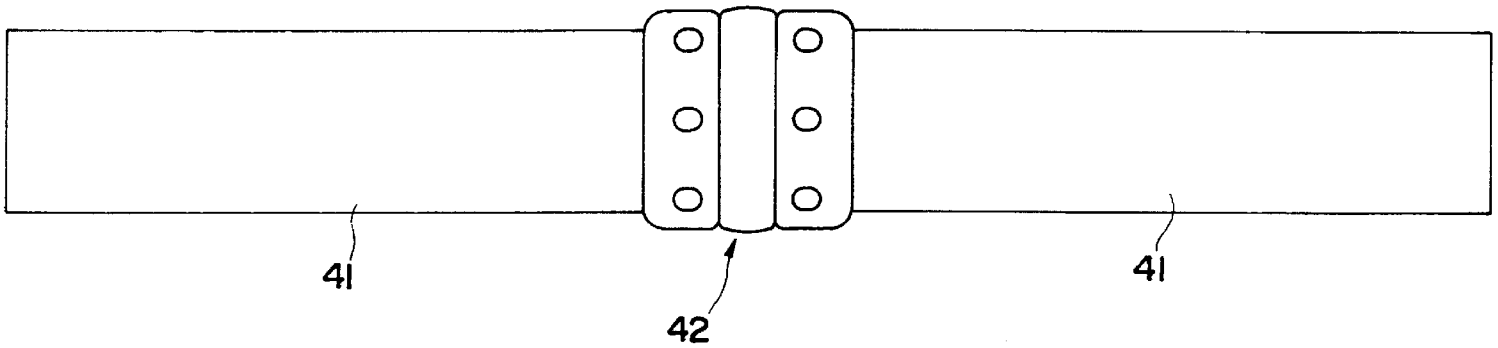
Figure 12C:
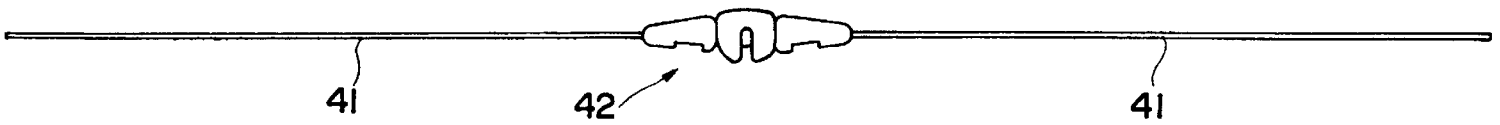
Figure 13A:
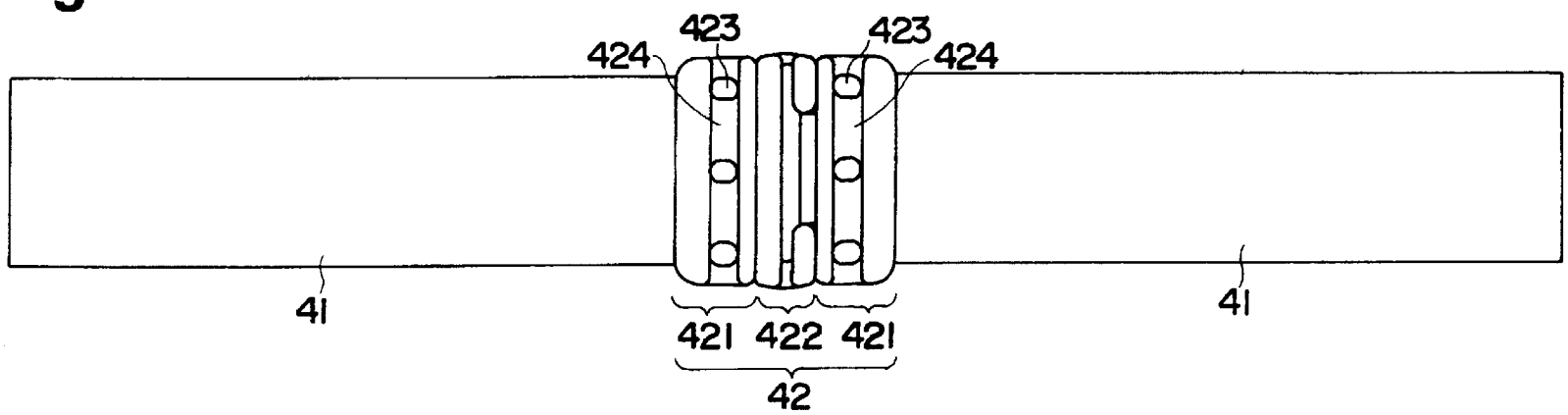
FIGS. 13A to 13C are views showing the tape-like connecting device of FIG. 1 in accordance with the embodiment, which are its rear view, left side view, and right side view, respectively.
Figure 13B:
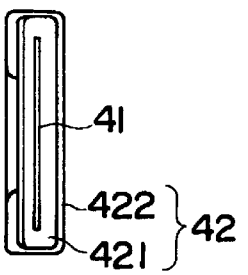
Figure 13C:
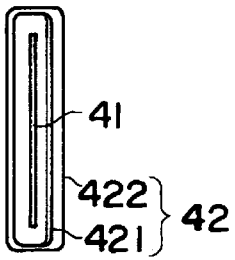

The tape-like connecting device 4 in accordance with this embodiment is identical to that used in the front-hook portion of the brassiere explained above (see FIGS. 1, 2, and 3). This configuration is shown in more detail in FIGS. 12A to 12C and FIGS. 13A to 13C, in which FIG. 12A is a plan view, FIG. 12B is a front view, FIG. 12C is a bottom view, FIG. 13A is a rear view, FIG. 13B is a left side view, and FIG. 13C is a right side view.

As shown in FIGS. 12A to 12C and FIGS. 13A to 13C, the tape-like connecting device 4 comprises a pair of connecting tapes(tape members) 41L, 41R and a pair of female/male connecting members 42L, 42R that constitute connector 42. The front end portions of the connecting tapes 41L, 41R are embedded into and fixed to flat base portions 421L, 421R of the connector 42. The connecting tapes 41L, 41R are formed by folding a woven fabric of a synthetic fiber from both sides and bonding thus folded parts to each other by laminating. The connecting tapes 41L, 41R each a width of about 15 mm (about 30 mm before folding) and a length of about 50 mm. The male/female connecting members 42L, 42R are formed by integrally molding the flat base portions 421L, 421R, which have substantially the same form in both female and male parts, with the female/male connecting portions 422L, 422R, which are adapted to connect with each other as mating with each other, from a plastic by injection molding using a die.

Characteristically, in this embodiment, both sides of each of the base portions 421L, 421R are formed with three depressions 423L, 423R which align vertically, whereas the surfaces of the connecting tapes 411, 41R are exposed at the bottom thereof. Each depression 423 has an elliptical form whose main axis lies in the longitudinal direction of the connecting tapes 41L, 41R and has such a size (a diameter of 1 to 2 mm) that a sewing needle can be inserted into the connecting tapes 41L, 41R exposed at the bottom surfaces of the depressions 423. Also, the rear sides of the base portions 421L, 421R are respectively formed with shallow recessed grooves 424L, 424R extending from the upper end parts to the lower end parts in the vertical direction across the connecting tapes 41L, 41R. As the three depressions 423 equidistantly align within the recessed groove 424, the sewn thread hung between the depressions is accommodated therein.

Figure 14:
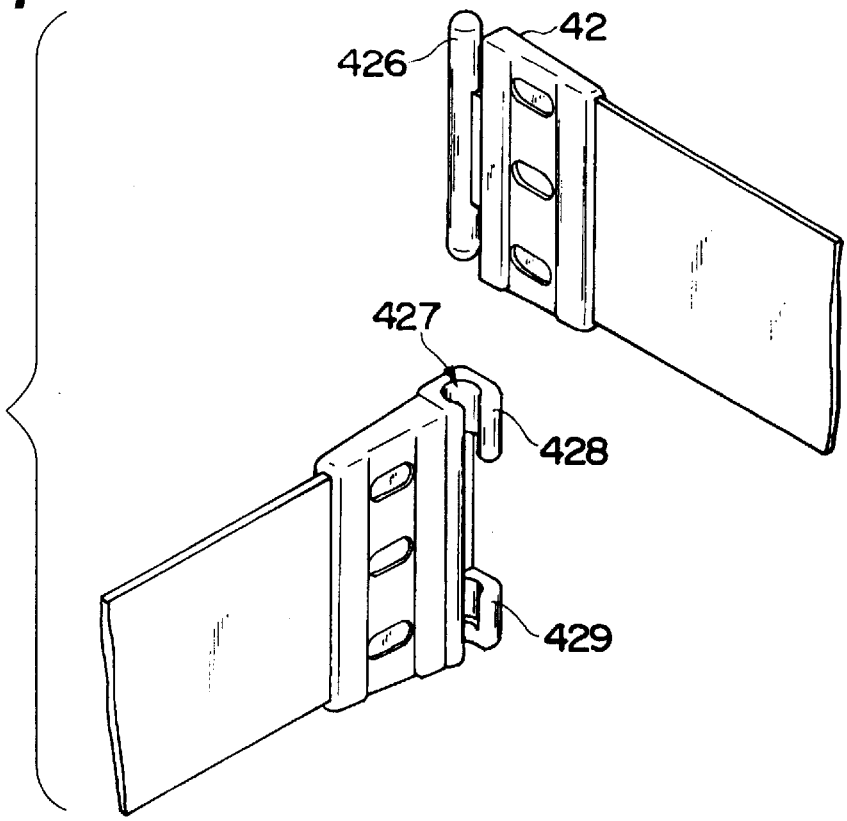
FIG. 14 is a perspective view showing a process of connecting the tape-like connecting device of FIG. 1.
Figure 15:
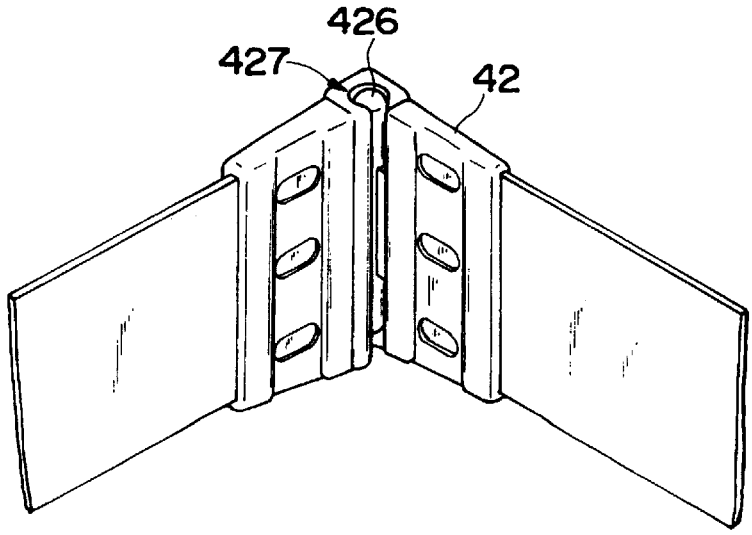
FIG. 15 is a perspective view showing a process of connecting the tape-like connecting device of FIG. 1.

FIG. 14 shows the state before connection, whereas FIG. 15 shows the state during connection. As shown in the perspective view of FIG. 14, the connecting portion 422 of the male connecting member of connector 42 has a pin 426 connected to the base portion 421 at its middle part; whereas the female connecting member of connector 42 has a pinning slit 427 into which the pin 426 of the male connecting member of connector 42 can vertically be inserted, and hook-shaped pinning strips 428, 429 formed at both upper and lower ends thereof. The protrusion on the inner face of the lower part of the pinning strip 429 is a stopper for the pin 426.

The attachment and detachment of the male and female connecting members of connector 42 are carried out such that, as shown in FIG. 14, the female and male connecting members of connector 42 are caused to intersect at right angles, and the pin 426 is inserted into the pinning slit 427 from the pinning strip 428 side or drawn therefrom in the opposite direction. When the female and male connecting members of connector 42 are returned to a parallel relationship (linear relationship) such as that shown in FIG. 1 from the inserted state shown in FIG. 15, then it becomes impossible to insert/extract the pin 426.

Each of the front end face of the base portion of the male connecting member of connector 42 and its opposed front end face of the female connecting member of connector 42 is a flat surface with rounded edges. Consequently, when the female and male connecting members of connector 42 are turned from the parallel (maximum opening=180 degrees) relationship shown in FIG. 1 to the right angle (minimum opening=90 degrees) relationship shown in FIG. 15 or from the right angle to parallel, then a clicking sound is generated at the instant when the parallel state is attained (or when released from the parallel state). Then, the maximum opening state shown in FIG. 1 is maintained with a fixed holding force. Thus, while the female and male connecting members of connector 42 are hinged together with the maximum opening of 180 degrees, they cannot be pivoted in the direction along the tape surfaces of the connecting tapes 41.

Figure 16:
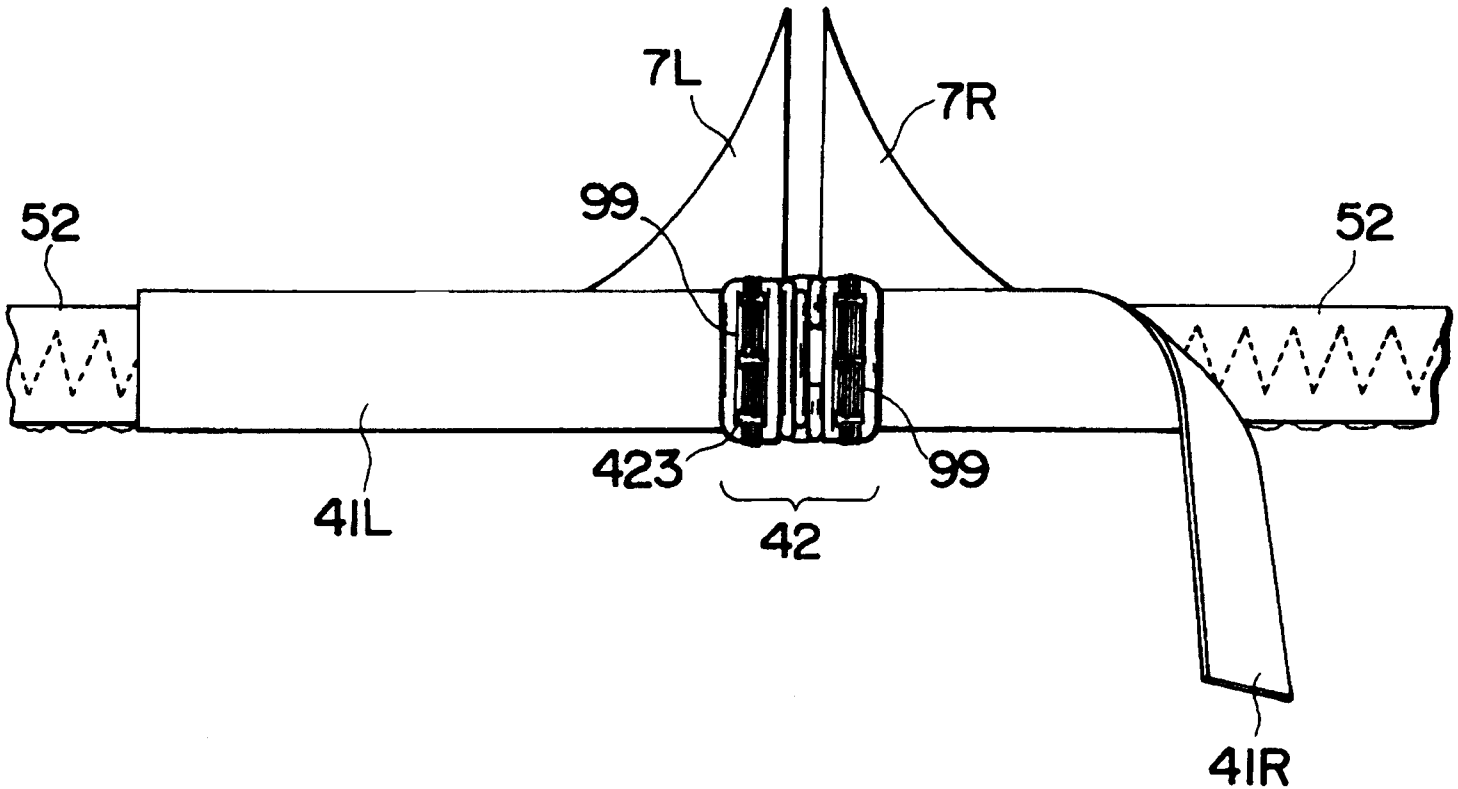
FIG. 16 is a perspective view showing an example of use of the tape-like connecting device shown in FIG. 1.

An example of the mode of use of the tape-like connecting device 4 in accordance with an embodiment will now be explained with reference to FIG. 16. FIG. 16 shows the state, in the manufacturing step of the front-hook type brassiere, where the tape-like connecting device 4 is secured to the center front cloths 7L, 7R and front portions 52L, 52R of under tape 5 with a sewing thread. Each part is sewn only at the position of the connector 42, whereas the sewing thread 99 is hung vertically by way of the depressions 423 of the connector 42.

This configuration results in the following particular operations and effects. First, individual parts of textile products such as a pair of left and right center front cloths 7L, 7R can be connected to each other in a mutually close state. It is due to the fact that they can be sewn at the position of the connector 42. Second, the front end portions of the connecting tapes 41L, 41R can firmly be secured to the individual parts of the textile product together with the connector 42. This is because of the fact that individual parts such as the connecting tapes 41L, 41R and the center front cloths 7L, 7R can directly be sewn to each other by way of the depressions 423 of the connector 42. Third, since the sewing thread is accommodated in the recessed grooves 424 of the connector 42, it does not become an obstruction. Fourth, since the connecting tapes 41L, 41R can be sewn to woven fabrics and nonwoven fabrics, it can be sewn to various kinds of parts of the textile product at any position.

Without being restricted to the above-mentioned embodiment, the tape-like connecting device of the present invention can employ various modes.

Figure 17:
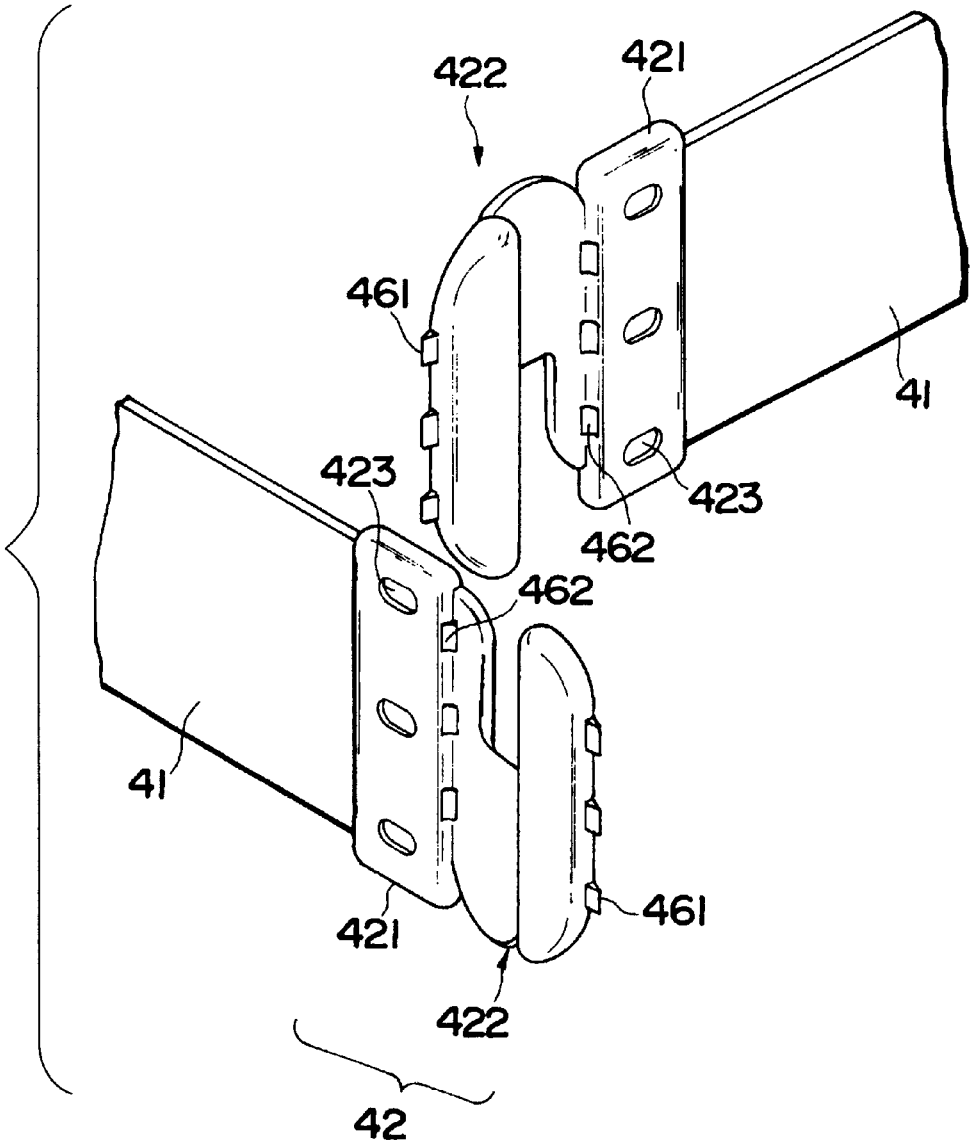
FIG. 17 is a perspective view showing another example of the tape-like connecting device.

FIG. 17 shows a first modified mode. It differs from the above-mentioned embodiment in the configuration of the connecting portions 422 of the connector 42. The substantially U-shaped left and right connecting portions 422 have identical forms, each having three engagement pins 461 at the front end part, which are adapted to engage with respective engagement holes 462 at the base portion 421, thereby keeping the mating state. Also, in this modified mode, depressions 423 are formed at three respective positions in both sides of the base portion 421 of each connecting member of connector 42, so as to allow the sewing thread to pass therethrough.

Figure 18:
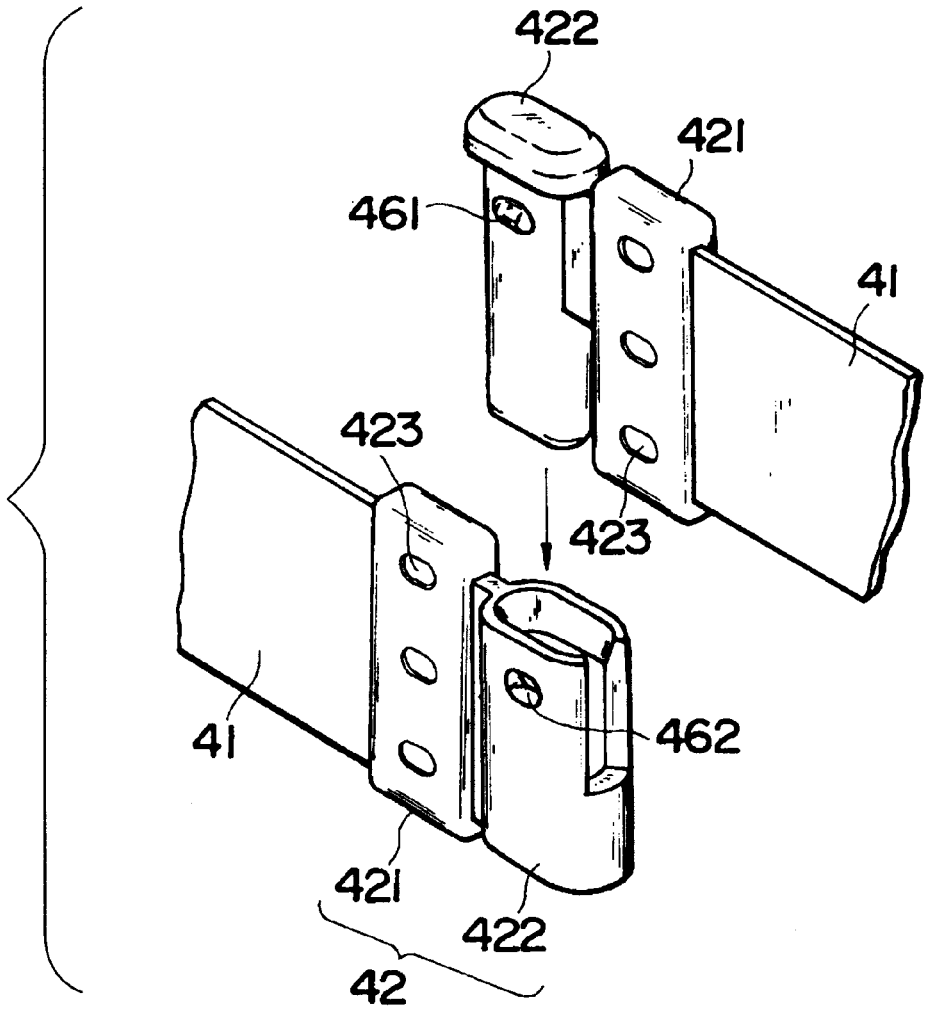
FIG. 18 is a perspective view showing still another example of the tape-like connecting device.

FIG. 18 shows a second modified mode. It differs from the above-mentioned embodiment in the configuration of the connecting portions 422 of the connector 42. There are female and male connecting portions 422 which are adapted to mate with each other. A side part of the male connecting portion 422 is provided with an engagement pin 461, whereas a side part of the female connecting portion 422 is formed with an engagement hole 462. As they engage each other, the mating state is maintained. Also, in this modified mode, depressions 423 are formed at three respective positions in both sides of the base portion 421, so as to allow the sewing thread to pass therethrough.

Figure 19:
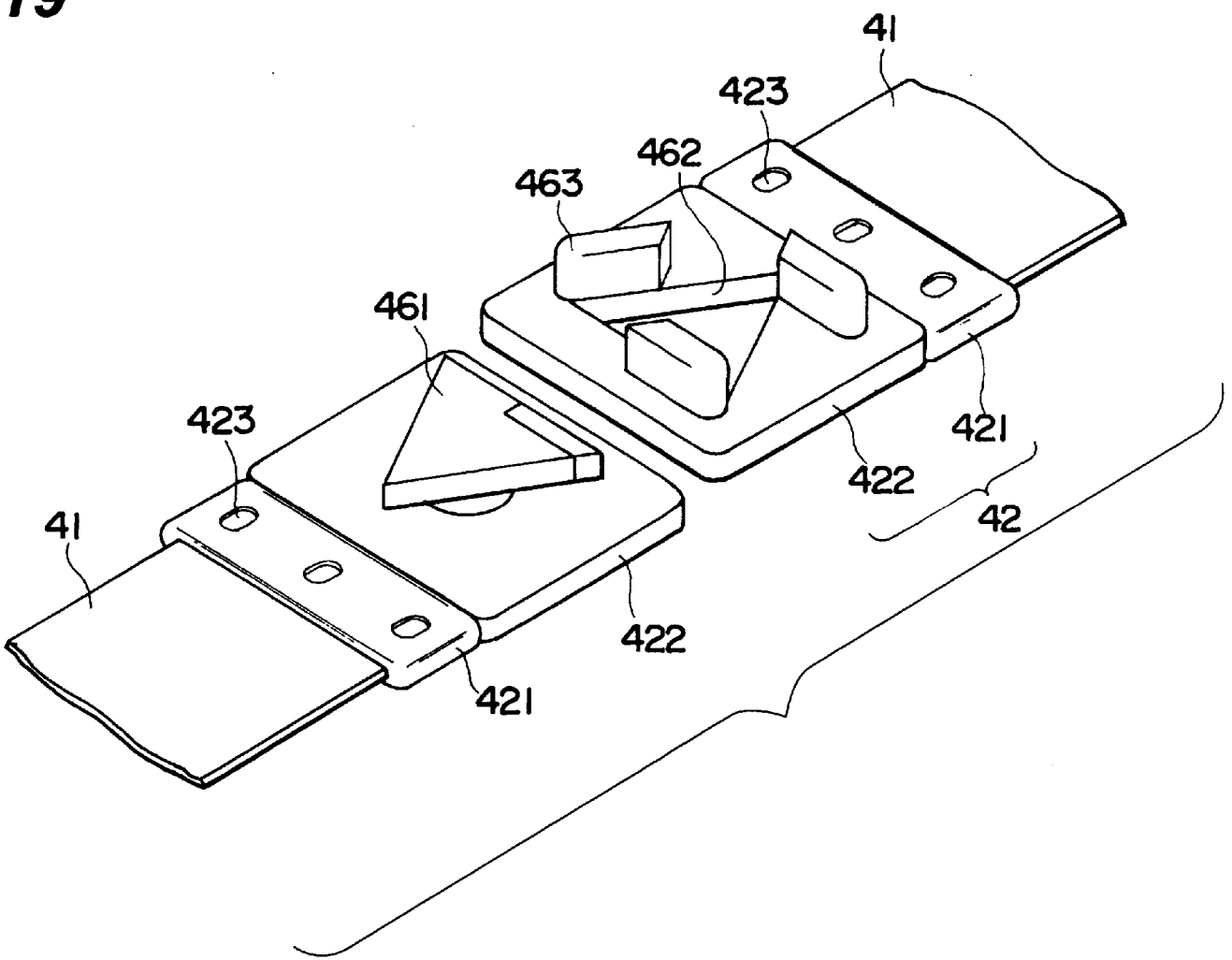
FIG. 19 is a perspective view showing still another example of the tape-like connecting device.

FIG. 19 shows a third modified mode. It differs from the above-mentioned embodiment in the configuration of the connecting portions 422 of the connector 42. There are female and male connecting portions 422 which are adapted to mate with each other. One side part of the male connecting portion 422 is provided with an engagement pin 461 having a head shaped like a regular triangle, whereas one side part of the female connecting portion 422 is formed with an engagement hole 462 shaped like a regular triangle and engagement projections 463. When the engagement pin 461 is inserted into the engagement hole 462 with an angle of intersection at 60 degrees, and then they are returned to the parallel state, they engage each other, thereby keeping the mating state. Also, in this modified mode, depressions 423 are formed at three respective positions in both sides of the base portion 421, so as to allow the sewing thread to pass therethrough.

Figure 20:
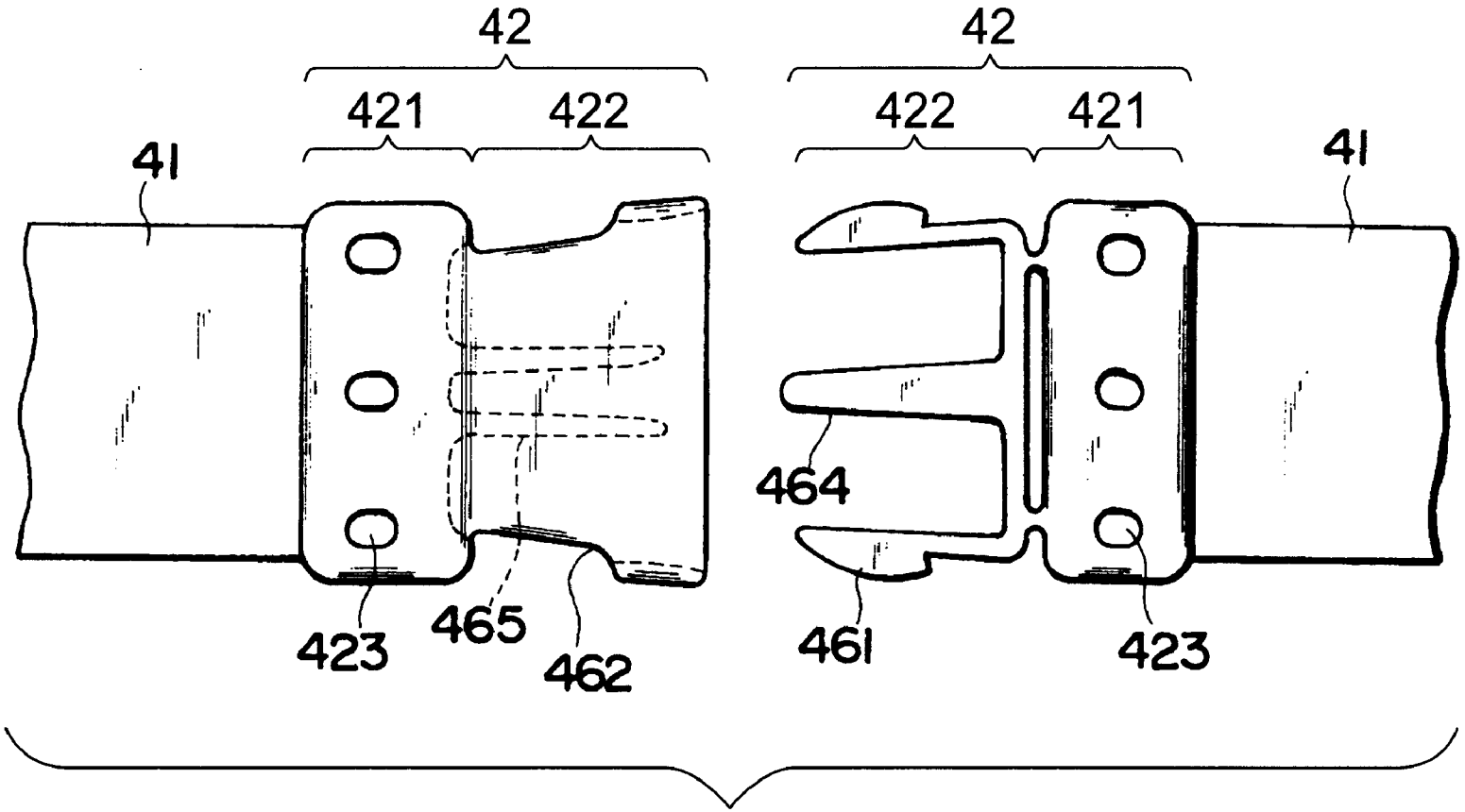
FIG. 20 is a perspective view showing still another example of the tape-like connecting device.

FIG. 20 shows a fourth modified mode. It differs from the above-mentioned embodiment in the configuration of the connecting portions 422 of the connector 42. There are female and male connecting portions 422 which are adapted to mate with each other. Both side face parts of the male connecting portion 422 are provided with engagement pins 461 each having a head projecting outward, whereas both side face parts of the female connecting portion 422 are formed with engagement holes 462 adapted to engage the respective heads of the engagement pins 461. When the male connecting portion 422 is inserted into the female connecting portion 422, they engage each other, thereby keeping the mating state. Here, a positioning pin 464 and a positioning partition 465 function to make it impossible for the connector 42 to rotate in the direction along the tape surface. Also, in this modified mode, depressions 423 are formed at three respective positions in both sides of the base portion 421, so as to allow the sewing thread to pass therethrough.

The tape-like connecting devices in accordance with the above-mentioned embodiments and modified modes are suitably applicable not only to various kinds of women's clothing with cups of the wire-form type, but also to non-wire front-hook type brassieres and the like. For example, it is applicable to non-wire bra-slips, bra-camisoles, three-in-ones, bodysuits, leotards, leotards, swimsuits, bra-dresses, and the like. In addition to strapless type brassieres and the like, the present invention is applicable to ¾-cup, full-cup, and half-cup brassieres and the like. It is also applicable to a two-part split type brassiere having hooks on both rear and front sides.

Also, the above-mentioned tape-like connecting device is applicable to the connection between a shoulder strap of a nursing brassiere and a cup portion thereof, and the connection of left and right back portions at the back center. Further, in textile products other than women's clothing with cups, the tape-like connecting device of the present invention can suitably be used for detachably connecting a part to another part in a stable manner while maintaining flexibility.

Here, the connecting tapes 41L, 41R are not limited to a tape material having a completely identical width in its longitudinal direction but may be a tape material whose width is broadened by the order of 10% to 20%, for example, at the base end portion (at the end part on the cup wire portion side in particular). Conversely, its width may be narrowed as well. Though the connector is preferably made so as not to be pivotable in the direction along the tape surface, and it is further desirably held (lightly locked) in the state where a pair of tape members are parallel (linear), it should not be restricted thereto. For example, the operations and effects resulting from the fact that the base portions of the connector are provided with depressions will not essentially be lost even if the connector is pivotable in the direction along the tape surface in the embodiment shown in FIG. 1.

INDUSTRIAL APPLICABILITY

In the tape-like connecting device of the present invention, as explained in detail in the foregoing, since the base portion of each of the connecting members (connector) is formed with a depression, the plastic-made connecting members themselves can firmly be attached to cloths or the like by way of the depressions. Also, at the above-mentioned depressions, the front end portions of the tape members or the like can be sewn to the cloths or the like at the same time. Further, since the base end portion sides of the tape members can be sewn to cloths or the like, the tape-like connecting device can be attached to individual parts of a textile product stably and firmly, while the individual parts are detachable by way of the connector (a pair of connecting members).

In the women's clothing product with cups in accordance with the present invention, since the front end portions of the center front cloths can be secured to the front side on the connector in an overlapping manner, the front ends of a pair of left and right center front cloths can be drawn to each other so that the left and right cup portions are caused to approach the center front. Also, since the plastic-made connector can be hidden between the center front cloths and the skin in the worn state, the fashionability of women's clothing product with cups can be improved. Further, the tape-like connecting device and the center front cloths mutually supplement their functions of connecting both cup portions to each other, whereby the under part can be stabilized in a so-called front-hook type brassiere or the like.

Therefore, lively beautiful proportions in which the bust is centered from both sides so as to enhance its volume can also be realized in a front-hook type brassiere or the like, while the breasts fitted into both cups as being lifted up and centered from their sides by the wearer's own hands at the initial stage of wearing are kept from dislocating and loosening after the brassiere is worn, with their side portions being shaped into a slim line for a long time.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A women's clothing product with cups comprising:

left and right cup portions each having an arc-shaped cup wire portion sewn to a lower curved part of a cup cloth portion;

a back portion connected to side edge parts of said left and right cup portions;

left and right center front cloths having respective end portions sewn to said left and right cup portions on a center front side thereof; and a tape-like connecting device having left and right tape members with respective base end portions sewn to said cup portions on a center front side thereof, and a pair of connection members disposed at respective front end sides of said left and right tape members and detachably connected to each other so as not to be vertically pivotable with respect to each other;

wherein said left and right connecting members each have a connecting portion and a base portion which are integrally formed from a plastic, each of said base portions being fixed to the respective front end portions of said left and right tape members, said base portions each being formed with at least one depression, the front end portions of said left and right tape members being sewn to respective front end portions of said center front cloths by way of said each of at least one depression.

2. A women's clothing product with cups according to claim 1, wherein said tape members are exposed at recessed surfaces of each of said at least one depression.

3. A women's clothing product with cups according to claim 1, wherein:

each of said at least one depression being at least two depressions; and a recessed groove for connecting said at least two depressions is formed in each of said connecting members.

4. A women's clothing product with cups according to claim 3, wherein said recessed groove extends along said connecting member to reach opposite ends thereof.

5. A women's clothing product with cups according to claim 1, wherein the front end portions of said left and right tape members are embedded in the base portions of said left and right connecting members, while said at least one depression are formed in both sides of said base portion of each of said connecting members at respective positions corresponding to each other.

6. A women's clothing product with cups according to claim 1, wherein an elastic under tape is attached to a lower edge part of said back portion, said under tape extending to a lower portion of said center front cloths and being sewn thereto, the front end portions of said center cloths and front end portions of said under tape being sewn to each other by way of said at least one depression.

7. A women's clothing product with cups according to claim 1, wherein the base end portions of said tape members are sewn to lower edge parts of said cup portions on the center front side thereof, while the lower edge parts of said cup portions, said under tape, and said tape-like connecting device are positioned on substantially an identical plane in a worn state.

8. A women's clothing product with cups according to claim 6, wherein the sewn position between said cup portions and said tape members is shifted toward the center front from the sewn position between said cup portions and said under tape.

9. A women's clothing product with cups according to claim 1, wherein said pair of connecting members are hinged together with a maximum opening of 180° on the skin side.

10. A women's clothing product with cups according claim 1, wherein said tape members have a width greater than that of the wire bias of said cup wire portions but not greater than 25 mm.

11. A women's clothing product with cups according to claim 1, wherein said pair of connecting members are formed by inserting the front end portions of said pair of tape members into a molding die and injecting a plastic into a cavity of said molding die.

12. A women's clothing product with cups according to claim 1, wherein the base portions of said pair of connecting members and the front end portions of said pair of tape members are fixed to each other by a plastic adhesive.

13. A women's clothing product with cups according to claim 1, wherein said pair of connecting members are formed from a thermoplastic, and said base portions of said pair of connecting members and the front end portions of said pair of tape members are fixed to each other by heat-melting and hardening said thermoplastic.

14. A women's clothing product with cups according to claim 1, wherein said pair of tape members comprise a knitted fabric, a woven fabric, or a nonwoven fabric; a composite material including a resin added to said fabrics; a patched body in which said fabrics are patched together by way of a resin; or a laminate in which one of said fabrics is laminated with a fiber cloth.

* * * * *